US007607186B1

(12) United States Patent
Mitchell

(10) Patent No.: US 7,607,186 B1
(45) Date of Patent: Oct. 27, 2009

(54) MODULAR WHEELCHAIR RAMP

(76) Inventor: Terry L Mitchell, 4801 Hillside Farm Estates, Grand Rapids, MI (US) 49525

( * ) Notice: Subject to any disclaimer, the term of this patent is extended or adjusted under 35 U.S.C. 154(b) by 0 days.

(21) Appl. No.: 11/494,188

(22) Filed: Jul. 27, 2006

Related U.S. Application Data

(60) Provisional application No. 60/815,067, filed on Jun. 20, 2006.

(51) Int. Cl.
*E01D 18/00* (2006.01)
*E01D 12/00* (2006.01)
*E01D 1/00* (2006.01)

(52) U.S. Cl. ..... 14/69.5; 52/174

(58) Field of Classification Search ..... 14/69.5, 14/71.1, 71.5, 73.1; D34/32; 414/921; 119/843; 405/218–221; 52/174, 175
See application file for complete search history.

(56) References Cited

U.S. PATENT DOCUMENTS

| | | | | | |
|---|---|---|---|---|---|
| 3,176,470 | A * | 4/1965 | Stiff | 405/218 |
| 4,050,828 | A * | 9/1977 | Noro | 403/201 |
| 4,079,476 | A * | 3/1978 | Green | 14/69.5 |
| 4,352,597 | A * | 10/1982 | Kay | 405/219 |
| 4,368,553 | A * | 1/1983 | Perry | 14/69.5 |
| 4,373,310 | A * | 2/1983 | Dean | 52/182 |
| 4,430,837 | A * | 2/1984 | Kirschenbaum | 52/506.05 |
| 4,630,709 | A * | 12/1986 | Taylor | 182/48 |
| 4,697,294 | A * | 10/1987 | Schafer | 14/69.5 |
| 4,807,317 | A * | 2/1989 | Quinn et al. | 14/69.5 |
| 4,865,312 | A * | 9/1989 | Katz | 472/116 |
| 5,281,055 | A * | 1/1994 | Neitzke et al. | 405/219 |
| 5,287,579 | A * | 2/1994 | Estevez, Jr | 14/71.1 |
| 5,347,672 | A * | 9/1994 | Everard et al. | 14/69.5 |
| D420,175 | S * | 2/2000 | Garrels, Jr. | D30/119 |
| 6,033,151 | A * | 3/2000 | Tsou | 405/219 |
| 6,179,525 | B1 * | 1/2001 | Gruhn et al. | 405/219 |
| 6,386,819 | B1 * | 5/2002 | Schultz | 414/537 |
| 6,418,675 | B1 * | 7/2002 | Peggs et al. | 52/102 |
| 6,430,769 | B1 * | 8/2002 | Allen | 14/69.5 |
| 6,725,487 | B2 * | 4/2004 | Myrick et al. | 14/69.5 |
| 6,875,116 | B2 * | 4/2005 | Tessier | 472/89 |
| 6,928,959 | B1 * | 8/2005 | Trauernicht et al. | 119/847 |
| 7,013,518 | B2 * | 3/2006 | Leblanc | 14/69.5 |
| 7,192,240 | B2 * | 3/2007 | Aulicino | 414/537 |
| 7,225,492 | B2 * | 6/2007 | Pratt | 14/69.5 |
| 7,225,751 | B2 * | 6/2007 | Rueckert | 114/259 |
| 7,237,294 | B2 * | 7/2007 | Lensing | 14/69.5 |
| 7,240,388 | B2 * | 7/2007 | Warford | 14/69.5 |
| 7,383,663 | B2 * | 6/2008 | Pacione | 52/120 |
| 2002/0078513 | A1 * | 6/2002 | Schouest | 14/69.5 |
| 2003/0182740 | A1 * | 10/2003 | Schmaltz et al. | 14/69.5 |
| 2004/0034950 | A1 * | 2/2004 | Massaro | 14/69.5 |
| 2004/0123811 | A1 * | 7/2004 | Bonsall | 119/843 |

* cited by examiner

*Primary Examiner*—Raymond W Addie
(74) *Attorney, Agent, or Firm*—Watson IP Group, PLC; Jovan N. Jovanovic; Vlaoan M. Vasiljevic

(57) ABSTRACT

A modular wheelchair ramp includes multiple, variously configurable ramp sections that are adapted to be assembled together to form or define a ramp surface upon which a wheelchair may traverse. The ramp sections may be held in an elevated orientation by support structures that may simultaneously receive mounting edges of adjacent ramp sections. Clamp members may then be used to securely clamp the adjacent ramp sections to the support structures. The wheelchair ramp may also be provided with adjustably formed railing assemblies that may include flexible wall assemblies installed to the railing assemblies.

13 Claims, 42 Drawing Sheets

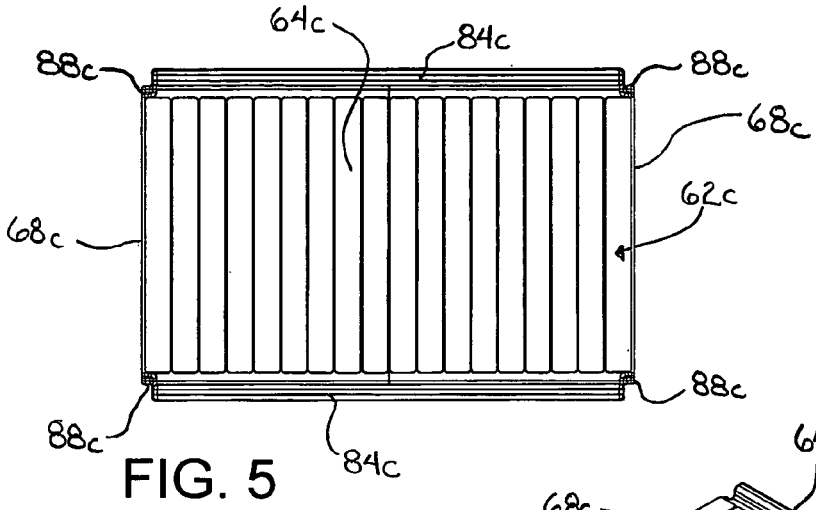
FIG. 5
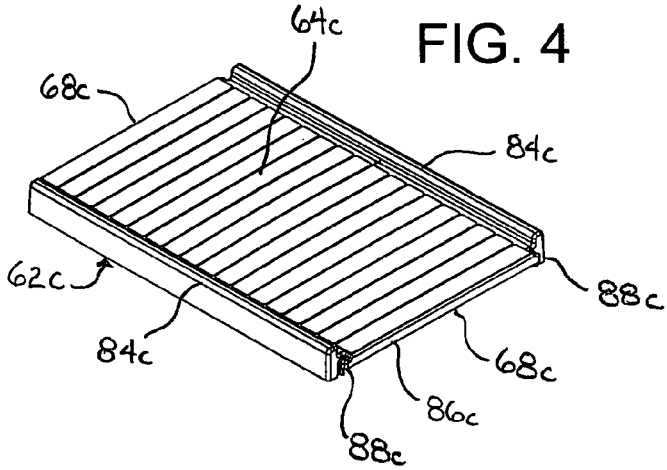
FIG. 4
FIG. 6
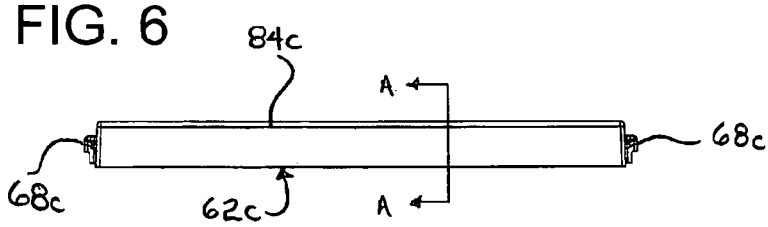
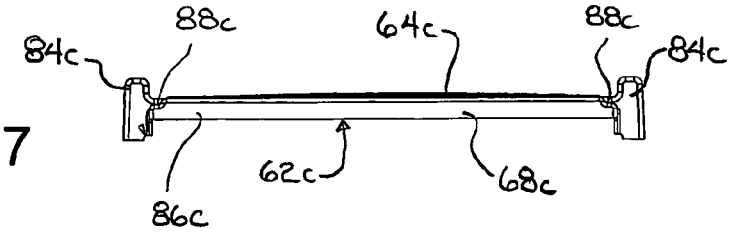
FIG. 7

MODULAR WHEELCHAIR RAMP

CLAIM OF PRIORITY

The present application claims priority of U.S. provisional application Ser. No. 60/815,067, filed Jun. 20, 2006, by Terry L. Mitchell for MODULAR WHEELCHAIR RAMP, which is hereby incorporated herein by reference in its entirety.

BACKGROUND AND TECHNICAL FIELD OF THE INVENTION

The present invention is directed to a modular wheelchair ramp for providing access for handicapped individuals into a building.

Wheelchair ramps are commonly used to enable or aid handicapped or impaired individuals to enter and exit structures, such as buildings and homes, having entry and exit ways that are elevated from a ground or support surface, such as a parking lot or sidewalk. Wheelchair ramps may be installed and used as a cost effective measure to insure that all individuals are able to gain access to structures, such as to government, private, or commercial buildings. Wheelchair ramps may, for example, be installed in the absence of an elevator, or even as an additional means of accessing a structure. Further, wheelchair ramps and/or a means for access into such facilities may even be mandated by federal, state, and local laws and zoning ordinances.

Typical wheelchair ramps are constructed in a custom manner at the facility or structure to which they are to be installed due to the large variations in government, private, and commercial buildings. For example, prior to constructing the wheelchair ramp, measurements such as the elevation of the entry way into the facility and the location of the entry way to the planned start of the wheelchair ramp must be considered. Wheelchair ramps are often constructed of cement or wood due to the ability to fabricate such materials at a particular worksite.

The custom making of wheelchair ramps, however, is costly in terms of time and materials. Further, such wheelchair ramps may be difficult to remove if it later becomes unneeded and/or may result in an unsightly ramp structure.

Therefore, there is a need in the art for a wheelchair ramp that may be readily assembled and configured for use with numerous possible arrangements of building and home structures.

SUMMARY OF THE INVENTION

The present invention provides a modular wheelchair ramp having variously configurable railing assemblies, ramp sections, support structures, and clamp members that enable wheelchair ramps to be readily assembled in numerous layouts and configurations. According to an aspect of the present invention, a wheelchair ramp comprises a plurality of ramp sections and a plurality of clamp members. Each of the ramp sections includes at least one mounting edge with the ramp sections being adapted for assembly to define a ramp surface upon which a wheelchair may traverse. The clamp members are adapted to clamp the mounting edges of adjacent ramp sections in adjoining relationship.

According to yet another aspect of the present invention, a wheelchair ramp comprises a plurality of ramp sections, a plurality of support structures, and a plurality of clamp members. The ramp sections are adapted for assembly to define a ramp surface upon which a wheelchair may traverse and the support structures are adapted to support the ramp sections in an elevated orientation with the clamp members adapted to clamp the ramp sections to the support structures.

According to still another aspect of the present invention, a wheelchair ramp comprises a plurality of ramp sections, a plurality of support structures, and a plurality of clamp members. The ramp sections are adapted for installation to the wheelchair ramp to define a ramp surface upon which a wheelchair may traverse. The support structures include at least one generally vertical member and the support structures are adapted to support the ramp sections in an elevated orientation with the clamp members adapted to clamp the ramp sections to the support structures. Each vertical member is adapted to receive at least one railing component that is adapted to extend between the at least one vertical member of adjacent support structures.

The modular wheelchair ramp of the present invention is adapted to be readily assembled in numerous configurations and is constructed of multiple, variously configurable ramp sections that are adapted to be assembled together to form or define a ramp surface upon which a wheelchair may traverse. The ramp sections may be constructed of a molded plastic or polymeric material and may be held in an elevated orientation by support structures that may simultaneously receive mounting edges of adjacent ramp sections. Clamp members may then be used to securely clamp the adjacent ramp sections to the support structures. The wheelchair ramp may also be provided with adjustably formed railing assemblies that may include flexible wall assemblies installed to the railing assemblies. The variously configurable railing assemblies, ramp sections, support structures, and clamp members thus enable wheelchair ramps to be readily assembled in numerous layouts or configurations.

These and other objects, advantages, purposes and features of the present invention will be apparent upon review of the specification in conjunction with the drawings.

BRIEF DESCRIPTION OF THE DRAWINGS

FIG. 4 is a perspective view of a straight ramp section of the wheelchair ramp of FIG. 1;

FIG. 5 is a top plan view of the straight ramp section of FIG. 4;

FIG. 6 is a side elevation view of the straight ramp section of FIG. 4;

FIG. 7 is a front elevation view of the straight ramp section of FIG. 4;

DESCRIPTION OF THE PREFERRED EMBODIMENTS

Figure 1:
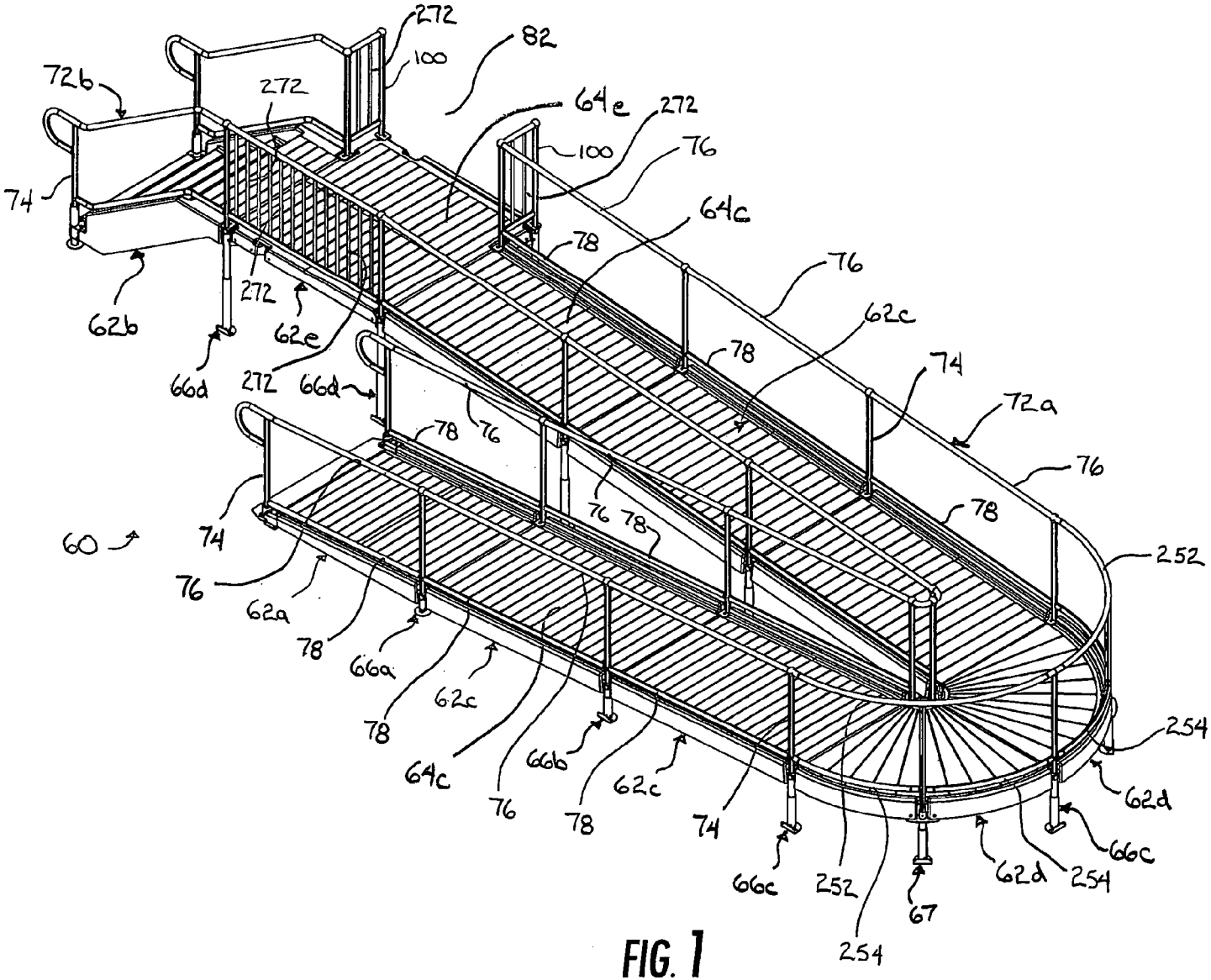
FIG. 1 is a perspective view of a wheelchair ramp in accordance with the present invention.

The present invention will now be described with reference to the accompanying figures, wherein the numbered elements in the following written description correspond to like-numbered elements in the figures. A modular wheelchair ramp is shown at 60 in FIGS. 1-3. The wheelchair ramp is constructed of multiple, variously configurable ramp sections 62 that are adapted to be assembled together to form or define a ramp surface 64 upon which a wheelchair may traverse. In the illustrated embodiment, the ramp sections 62 are constructed of a molded plastic or polymeric material which may be held in an elevated orientation by support structures 66. As described in more detail below, a number of the support structures 66 are adapted to simultaneously receive mounting edges 68 (FIG. 4) of adjacent ramp sections 62. Clamp members 70 (FIG. 19) may then be used to securely clamp the adjacent ramp sections 62 to the support structures 66. The wheelchair ramp 60 may also be provided with adjustably formed railing assemblies 72*a*, 72*b*. The illustrated railing assemblies 72*a*, 72*b*, as also described in more detail below, incorporate post members or vertical members 74 received by the support structures 66 and include upper and lower rail members 76, 78 mounted between the vertical members 74. Flexible wall assemblies 80*a*, 80*b* (see FIGS. 44 and 45) may also be installed to the railing assemblies 80*a*, 80*b*. The variously configurable railing assemblies 80*a*, 80*b*, ramp sections 62, support structures 66, and clamp members 70 thus enable wheelchair ramps to be readily assembled in numerous layouts or configurations.

Referring again to FIGS. 1-3, the ramp sections 62 are shown to include a first section, which in the illustrated embodiment is shown as a support surface section 62*a*, and a last section, which in the illustrated embodiment is shown as a step section 62*b*. When assembled, the illustrated wheelchair ramp 60 incorporates numerous central ramp sections disposed between the support surface section 62*a* and the step section 62*b*, including straight ramp sections 62*c*, curved ramp sections 62*d*, and a platform section 62*e*. The aforementioned central ramp sections are held in an elevated, inclined manner by support structures 66*a*-66*e*. Thus, an occupant of a wheelchair is able to travel between, for example, support surface section 62*a* and the opening 82 of platform section 62*e*, where opening 82 is adapted to be located at a doorway or entryway of a house, building, or the like (not shown), such that the wheelchair occupant may use wheelchair ramp 60 to enter and exit the structure. As previously noted, in the illustrated embodiment ramp sections 62 are formed by a molding process. However, it should be appreciated that ramp sections 62 may be formed, in part or in whole, of alternative materials, such as wood and/or metallic materials, and still function as intended within the present invention.

Figure 8:
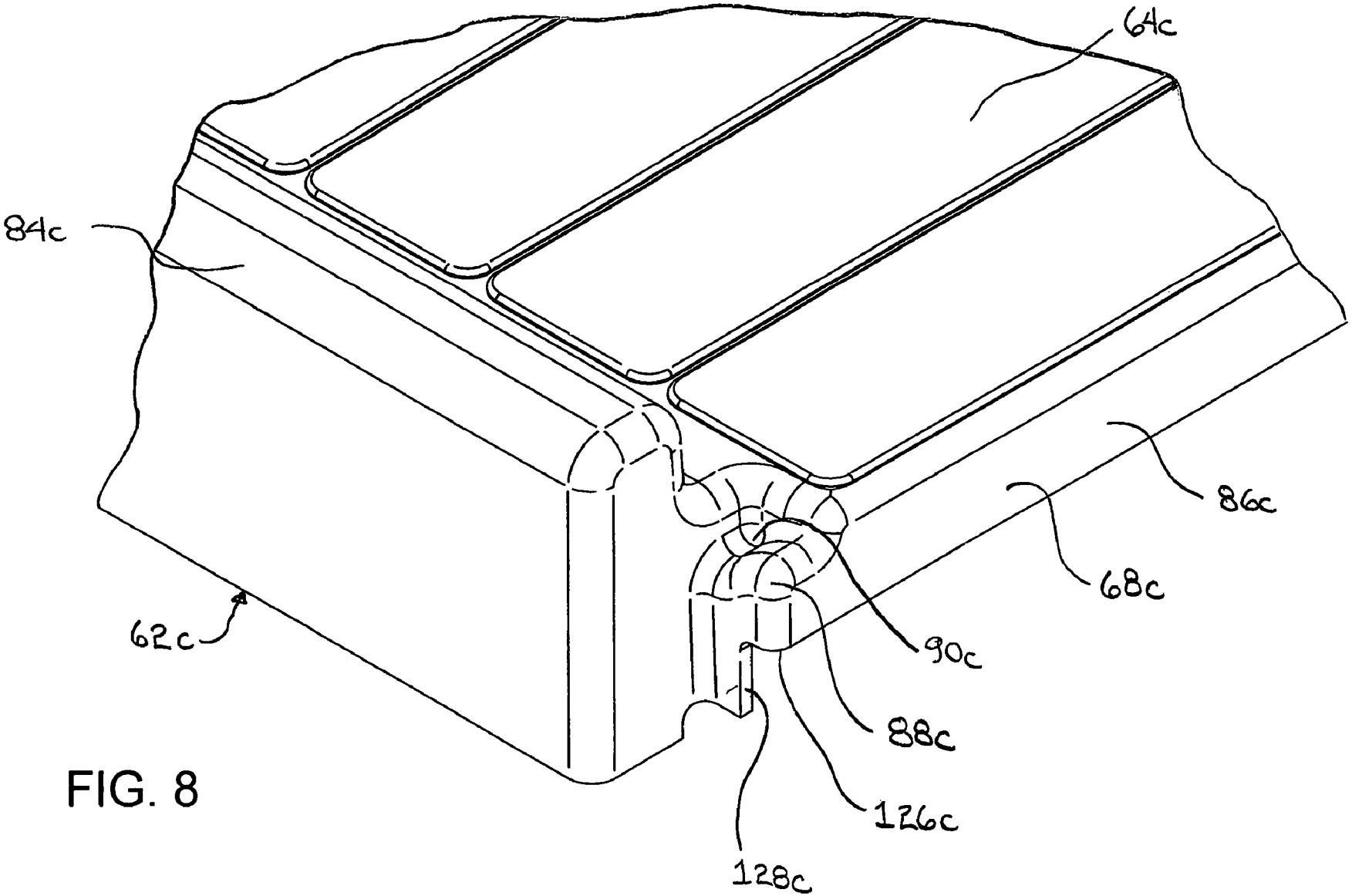
FIG. 8 is a close up perspective view of a mounting edge and clamp socket of the straight ramp section of FIG. 4.
Figure 9:
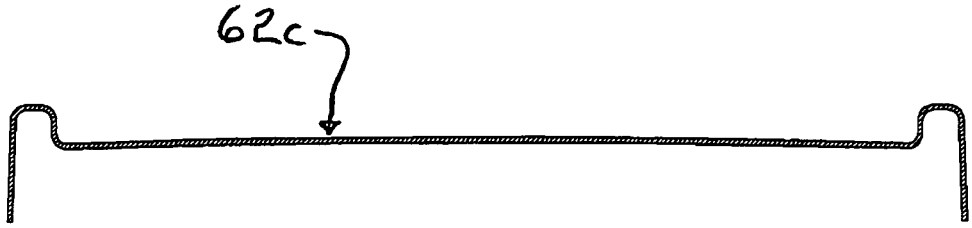
FIG. 9 is a front sectional view of the straight ramp section of FIG. 4 taken along the line A-A of FIG. 6.

Referring now to FIGS. 4-9, a straight ramp section 62*c* is illustrated that is generally rectangular or square in construction and includes multiple edges, including side edges 84*c* and mounting edges 68*c*. Straight ramp section includes a ramp surface 64*c* that, due to the molded nature of the illustrated embodiment, may include a textured surface, such as the "slat" type appearance shown, to provide traction thereon. Side edges 84*c* extend along the direction of travel on straight ramp section 62*c* with a portion of side edges 84*c* extending above ramp surface 64*c*. (FIGS. 7 and 9).

Each mounting edge 68*c* of straight ramp sections 62*c*, as described in more detail below, is adapted to be assembled in adjoining relation to a mounting edge 68 of an adjacent ramp section 62. For example, a mounting edge 68*c* may be assembled in adjoining relation to a mounting edge 68*c* of another straight ramp section 62*c*, or to a mounting edge 68 of a support surface section 62*a*, a curved ramp section 62*d*, a platform section 62*e*, or a step section 62*b*. Mounting edge 68*c* includes an abutment surface or face 86*c* that, as described below, is adapted to contact a similar abutment surface 86*c* on an adjacent ramp section 62.

In the illustrated embodiment, mounting edges 68*c* each include two clamp sockets 88*c* such that straight ramp section 62*c* is provided with four clamp sockets 88*c* that are located generally proximate the corners of straight ramp section 62*c*. Referring to FIG. 8, clamp socket 88*c* is shown to include a pocket or recess 90*c* for receiving a portion of the below described clamp member 70 used to cooperatively retain the ramp sections 62 in assembled orientation to form wheelchair ramp 60.

Figure 2:
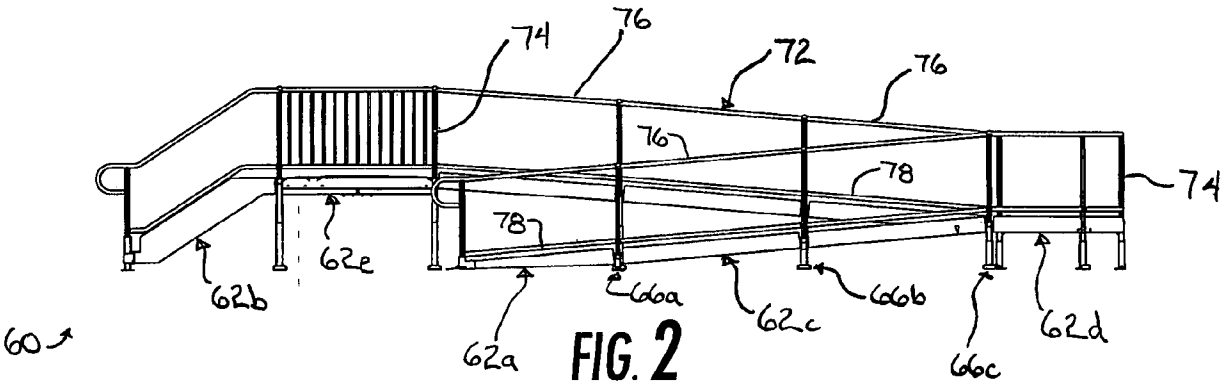
FIG. 2 is a side elevation view of the wheelchair ramp of FIG. 1.
Figure 3:
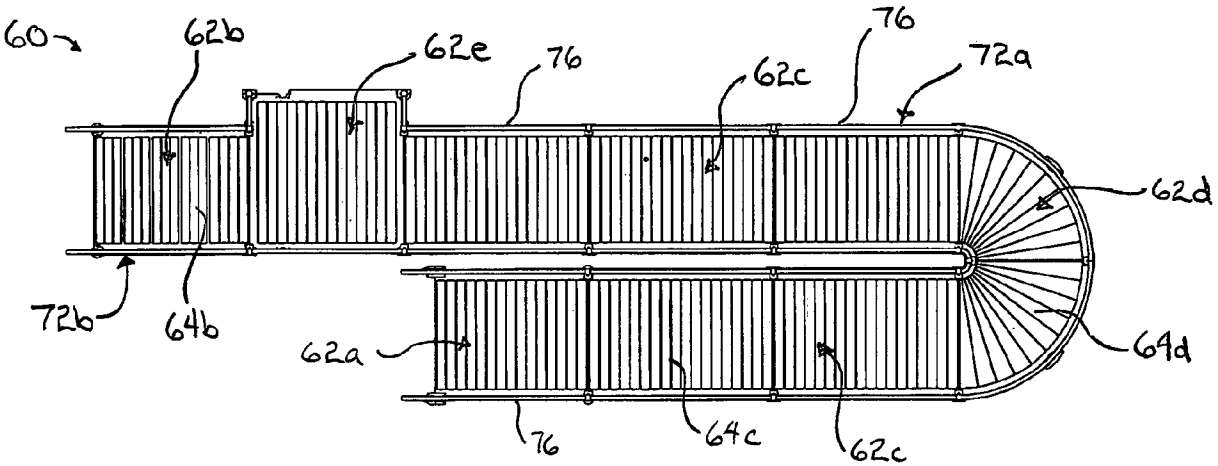
FIG. 3 is a top plan view of the wheelchair ramp of FIG. 1.
Figure 10:
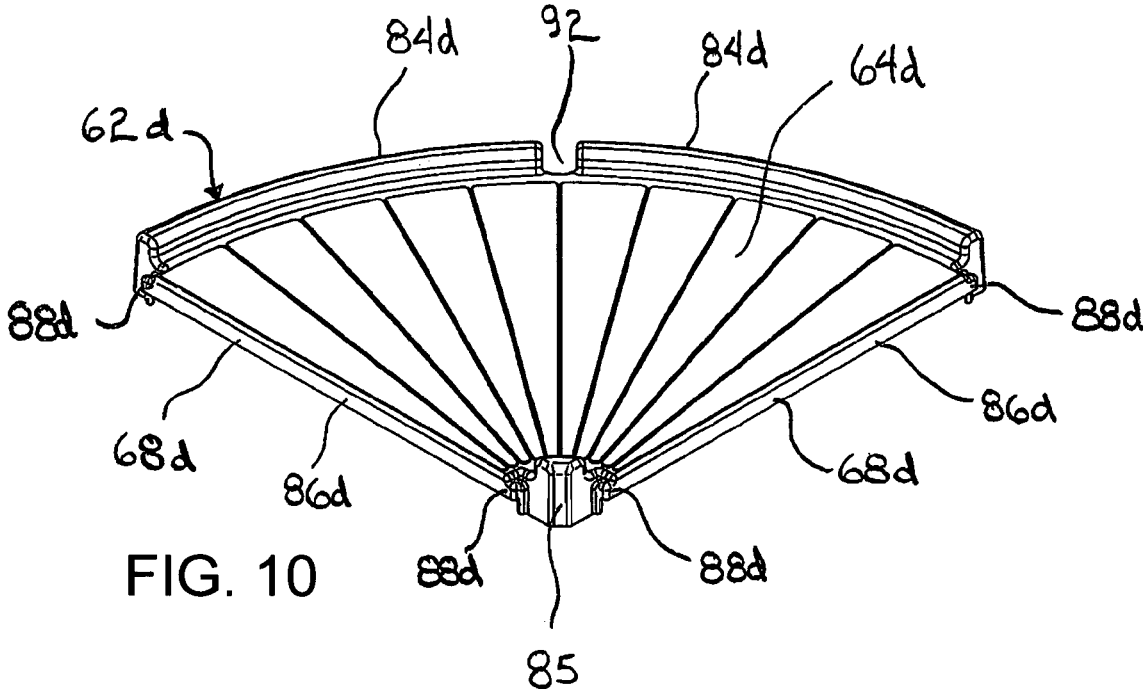
FIG. 10 is a curved ramp section of the wheelchair ramp of FIG. 1.

FIG. 10 illustrates a curved ramp section 62*d* that, as shown in FIGS. 1-3, is used to alter or reverse the travel direction on wheelchair ramp 60. The wheelchair ramp 60 of FIGS. 1-3 employs two substantially identical curved ramp sections 62*d* mounted in adjacent relation to form a 180 degree turn to the direction of travel on wheelchair ramp 60. Each curved ramp section 62*d* defines a 90 degree segment or arc that includes two mounting edges 68*d*, an outer side edge 84*d*, and a central hub portion 85. In the illustrated embodiment, mounting edges 68*d* of curved ramp sections 62*d* are substantially identical to mounting edges 68*c* of straight ramp sections 62*c* described above. For example, mounting edges 68*d* of curved ramp sections 62*d* include an abutment face 86*d* and two clamp sockets 88*d* that are generally distally located from each other on the mounting edge 68*d*, and which generally protrude or extend from the curved ramp section 62*d*. The mounting edges 68*d* of curved ramp section 62*d* are generally the same length as the mounting edges 68*c* of straight ramp section 62*c* and, although not shown in detail, the clamp sockets 88*d* of curved ramp sections 62*d* include a pocket or recess in like manner to recess 90*c*.

Curved ramp section 62*d* includes a slat-like molded ramp surface 64*d* that is of generally similar formation as ramp surface 64*c* of straight ramp section 62*c*. Curved ramp section 62*d* also includes a mid-support receptacle 92 used to receive a support structure 67 (FIG. 1) that may provide additional elevation support to the curved ramp section 62*d* and/or enable the inclusion of a railing assembly 72*a*, 72*b* in the manners described below. Although curved ramp section 62*d* is illustrated as a generally 90 degree segment, it should be appreciated that alternative curved ramp sections may define curved segments forming greater or smaller angles.

Figure 11:
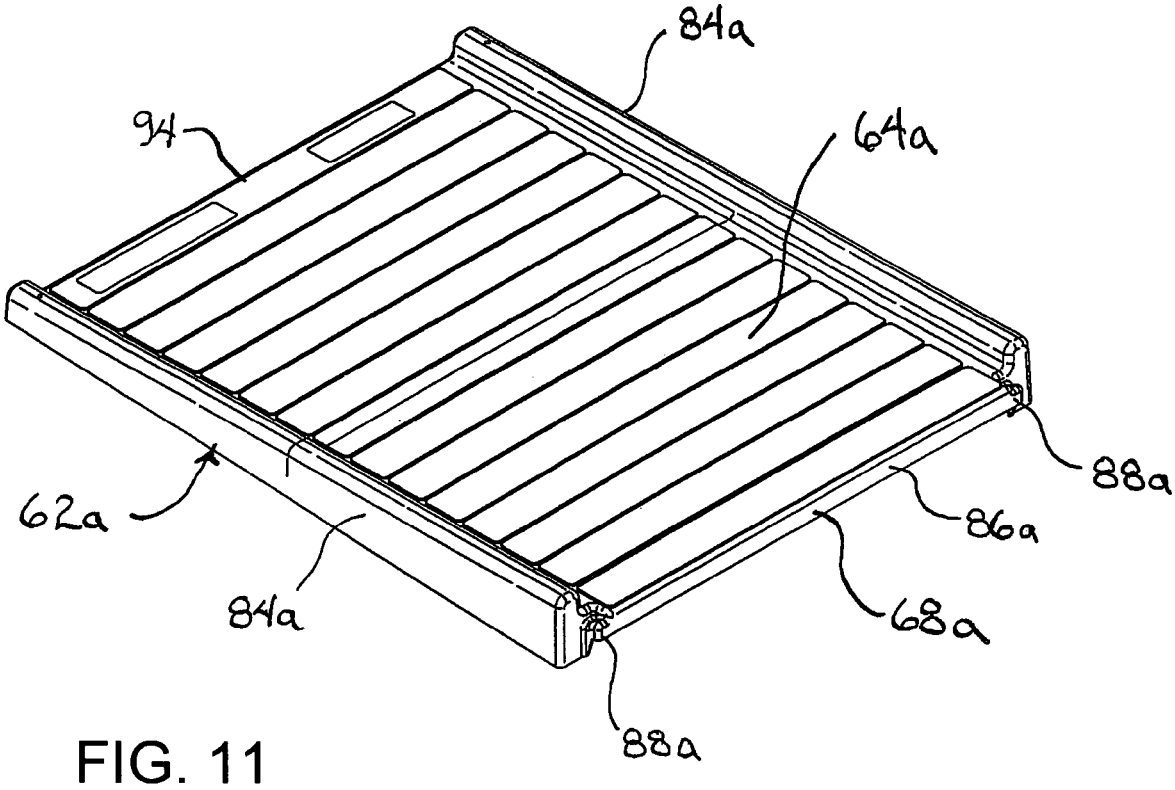
FIG. 11 is a support surface section of the wheelchair ramp of FIG. 1.

FIG. 11 illustrates a support surface section 62*a* that, as understood from FIGS. 1-3, includes an end or edge 94 that is adapted to contact or be placed proximate a surface (not shown) onto which or from which an occupant of a wheelchair may travel from or onto the wheelchair ramp 60. The surface may be, for example, a sidewalk, parking lot, driveway, gravel, yard, or the like. As shown, support surface section 62*a* also includes side edges 84*a* and a mounting edge 68*a*. Mounting edge 68*a* of support surface section 62*a* includes an abutment face 86*a* and two clamp sockets 88*a* and is substantially similar to mounting edges 68*c*, 68*d* of straight ramp section 62*c*, and curved ramp sections 62*d*, respectively, described above. Side edges 84*a* of support surface section 62*a* are also generally similar to side edges 84*c* of straight ramp section 62*c* described above in that a portion of the side edges 84*a* extend above the slat-like ramp surface 64*a* of support surface section 62*a*.

Figure 12:
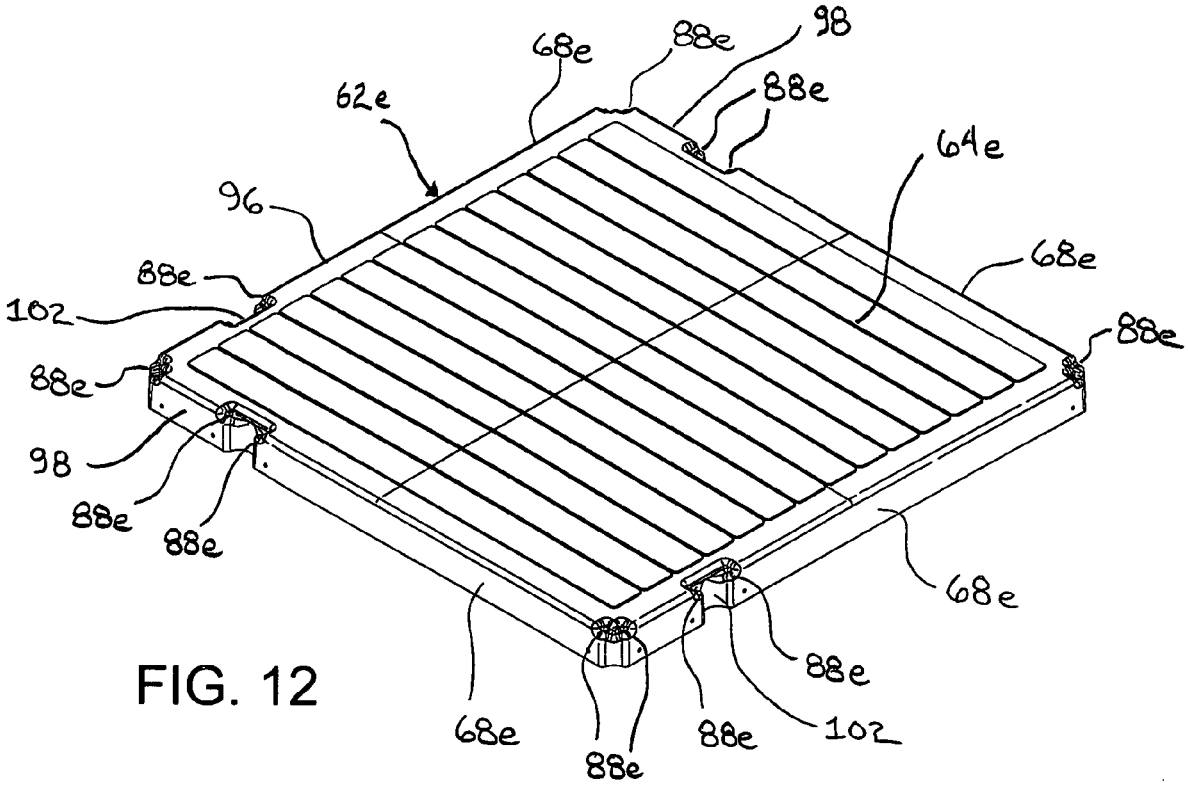
FIG. 12 is a perspective view of a platform section of the wheelchair ramp of FIG. 1.

FIG. 12 illustrates a platform section 62*e* that, as shown in FIGS. 1-3 and noted above, provides an opening 82 that is used as the point of exit from the wheelchair ramp 60 to enter into the structure against which the wheelchair ramp 60 is placed or mounted. Platform section 62*e* includes a structure mounting edge 96 that, as described below, may be used to affix the wheelchair ramp 60 to the structure. As shown, platform section 62*e* is slightly wider than the width of the illustrated straight ramp sections 62*c*, which may provide room or clearance for an occupant of a wheelchair to turn his or her wheelchair to align with the entryway of the structure or the inclined ramp sections 62.

Platform section 62*e* includes mounting edges 68*e* that are of substantially similar construction to the aforementioned mounting edges 68*a*, 68*c*, 68*d*, with each mounting edge 68*e* including two clamp sockets 88*e*, to enable the platform section 62*e* to be assembled in adjoining relation to adjacent ramp sections 62. For example, one mounting edge 68*e* may be used for assembly with a mounting edge 68*c* of a straight ramp section 62*c* and another mounting edge 68*e* may be used for assembly with a step section 62*b*. Platform section 62*e* also includes a slat-like ramp surface 64*e* and two side-mounting edges 98. Side-mounting edges 98 are similar in form to mounting edges 68*e* and include two clamp sockets 88*e*, but are of substantially shorter length. Side-mounting edges 98, as shown in FIGS. 1 and 3, are in-part adapted for use in providing railing 100 to wheelchair ramp 60. Platform section 62*e* further includes additional clamp member receiving areas 102 that may be used with alternatively sized openings and/or may be used to alternatively orient platform section 62*e* with respect to a wheelchair ramp 60.

Figure 13:
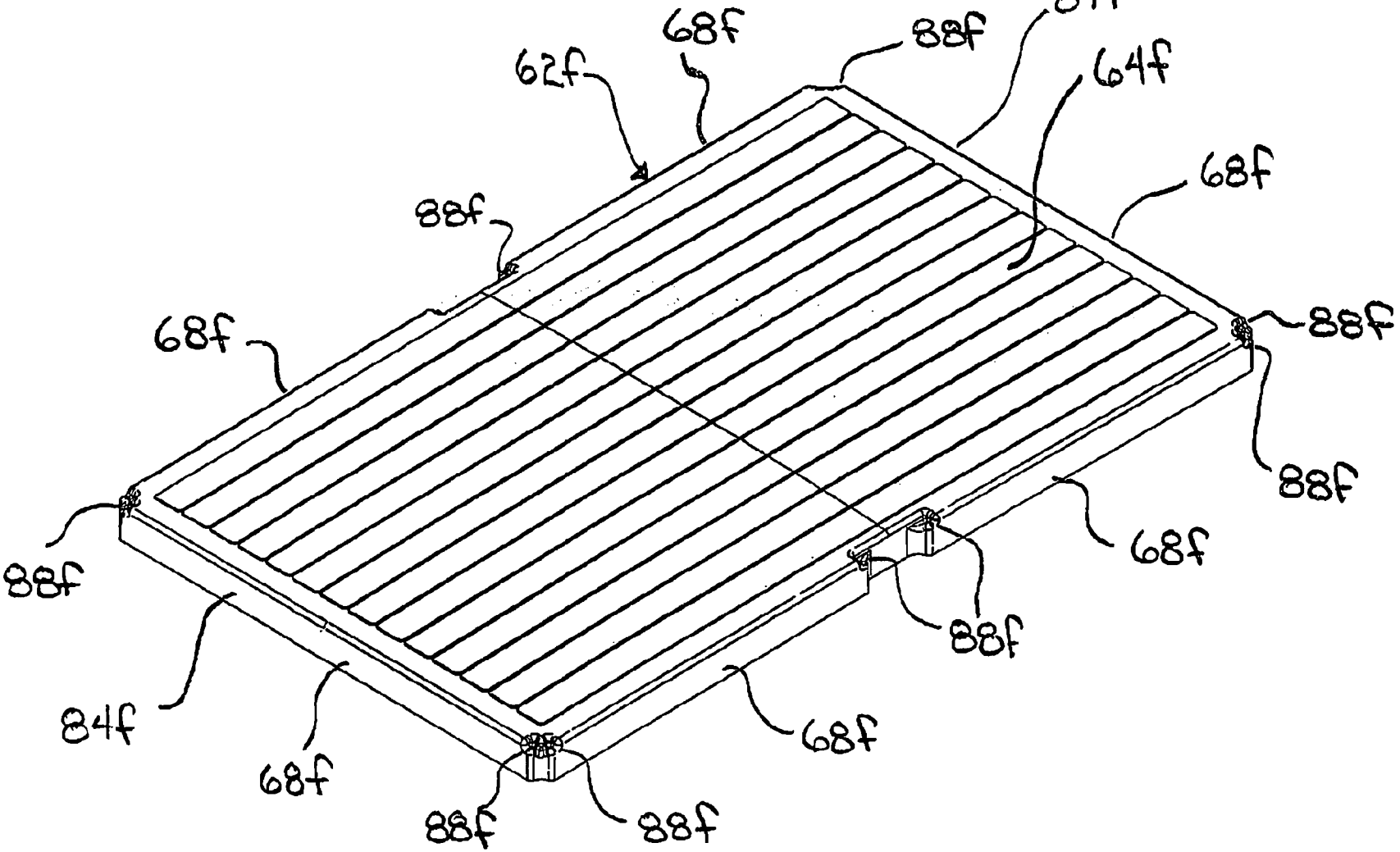
FIG. 13 is a perspective view of an alternative platform section for use with a wheelchair ramp in accordance with the present invention.

FIG. 13 discloses an alternative platform section 62*f* ramp section (not shown in FIGS. 1-3) that may be used in addition to or in place of any of certain of the ramp sections 62 of wheelchair ramp 60. Platform section 62*f* includes six mounting edges 68*f*, each of which includes two clamp sockets 88*f* in similar manner to mounting edges 68*a*, 68*c*, 68*d*, 68*e* discussed above. Therefore, due to the number of mounting edges 68*f* of platform section 62*f*, it should be appreciated that platform section 62*f* provides multiple locations at which it may be joined with other ramp sections 62 to construct numerous differently styled or shaped wheelchair ramps. For example, straight ramp sections 62*c* may be assembled to two of the mounting edges 68*f* of platform section 62*f* in a declined manner with two other straight ramp sections 62*c* also being assembled to two of the mounting edges 68*f* of platform section 62*f* in an inclined manner to create a wheelchair ramp that allows entry/exit from a building structure and to the wheelchair ramp at two locations.

Platform section 62*e* also incorporates a slat-like ramp surface 64*f*, but its side edges 84*f* do not have portions extending above the ramp surface 64*f* in the manner of straight ramp section 62*c*. One or more platform sections 62*f* may be used, for example, as a "switchback" to alter the direction of travel on a wheelchair ramp, such as in place of the two curved ramp sections 62*d* of wheelchair ramp 60. Platform section 62*f* may also be used in place of or in conjunction with platform section 62*e* of FIG. 12 at the entrance/exit of a structure at which a wheelchair ramp is located adjacent. Multiple platform sections 62*f* may also be used to construct a wider wheelchair ramp than that shown in FIGS. 1-3, such as in place of straight ramp sections 62*c*.

Figure 14:
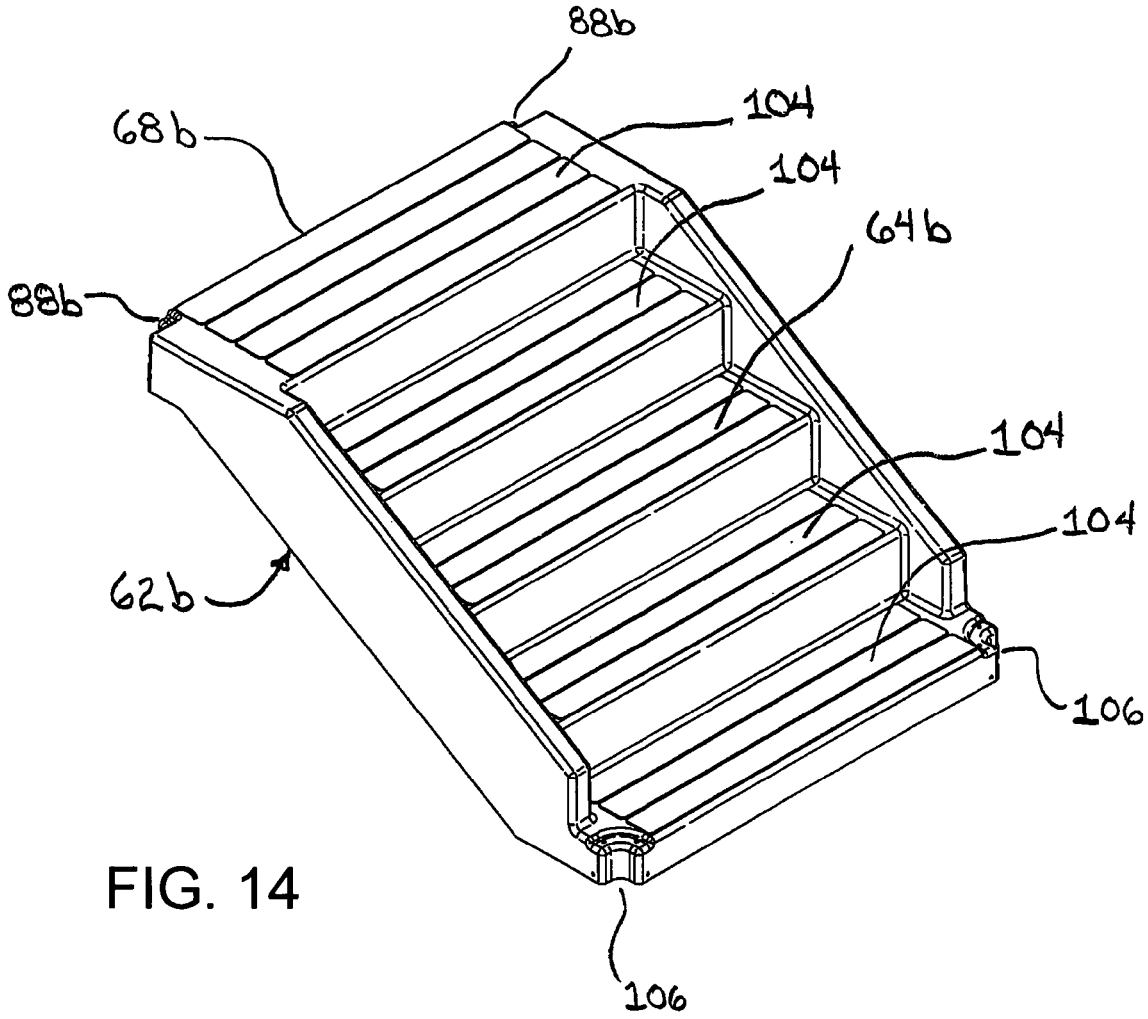
FIG. 14 is a perspective view of a step section of the wheelchair ramp of FIG. 1.

FIG. 14 illustrates a step section 62*b* that, as understood from FIGS. 1-3, may be used to enter and/or exit a building structure at an elevated location above a support surface without traversing the angled ramp sections 62*a*, 62*c* of wheelchair ramp 60. Step section 62*b* includes a mounting edge 68*b* having two clamp sockets 88*b* for engaging a mounting edge 68 of an adjacent ramp section 62, such as a mounting edge 68*e* of platform section 62*e* as illustrated in FIGS. 1-3. Step section 62*b* includes five steps 104, each of which has a slat-like ramp surface 64*b*, and adjacent the lower most step 104, step section 62*b* includes two post receiving portions 106 for receiving a bracket described in detail below. It should be appreciated, however, that alternative step sections may incorporate more or less than five steps and/or differently styled ramp surfaces. Further, an alternative step section may be constructed to incorporate a platform section at the top or uppermost step having more than one mounting edge such that the step section may be assembled in adjoining relationship with more than one ramp section.

It should be appreciated that the various ramp sections discussed above may be alternatively configured and still function as intended within the scope of the present invention. For example, a straight ramp section may be constructed to have a longer or shorter length and/or width. The ramp sections may also employ an alternative ramp surface, such as a perforated surface, or cross-hatched style surface, or rough textured style surface. Side edges of straight ramp sections may be constructed without portions elevated above the ramp surface. Further, although the various mounting edges of the ramp sections discussed above extend or protrude from the ramp sections, it should be appreciated that the ramp sections may alternatively not include a clamp socket and/or an abutment face that protrudes from the ramp section and still function as intended within the scope of the present invention. Still further, a ramp section may be constructed to have a recessed or indented mounting edge adapted to receive a protruding mounting edge from an adjacently mounted or assembled ramp section.

Figure 15:
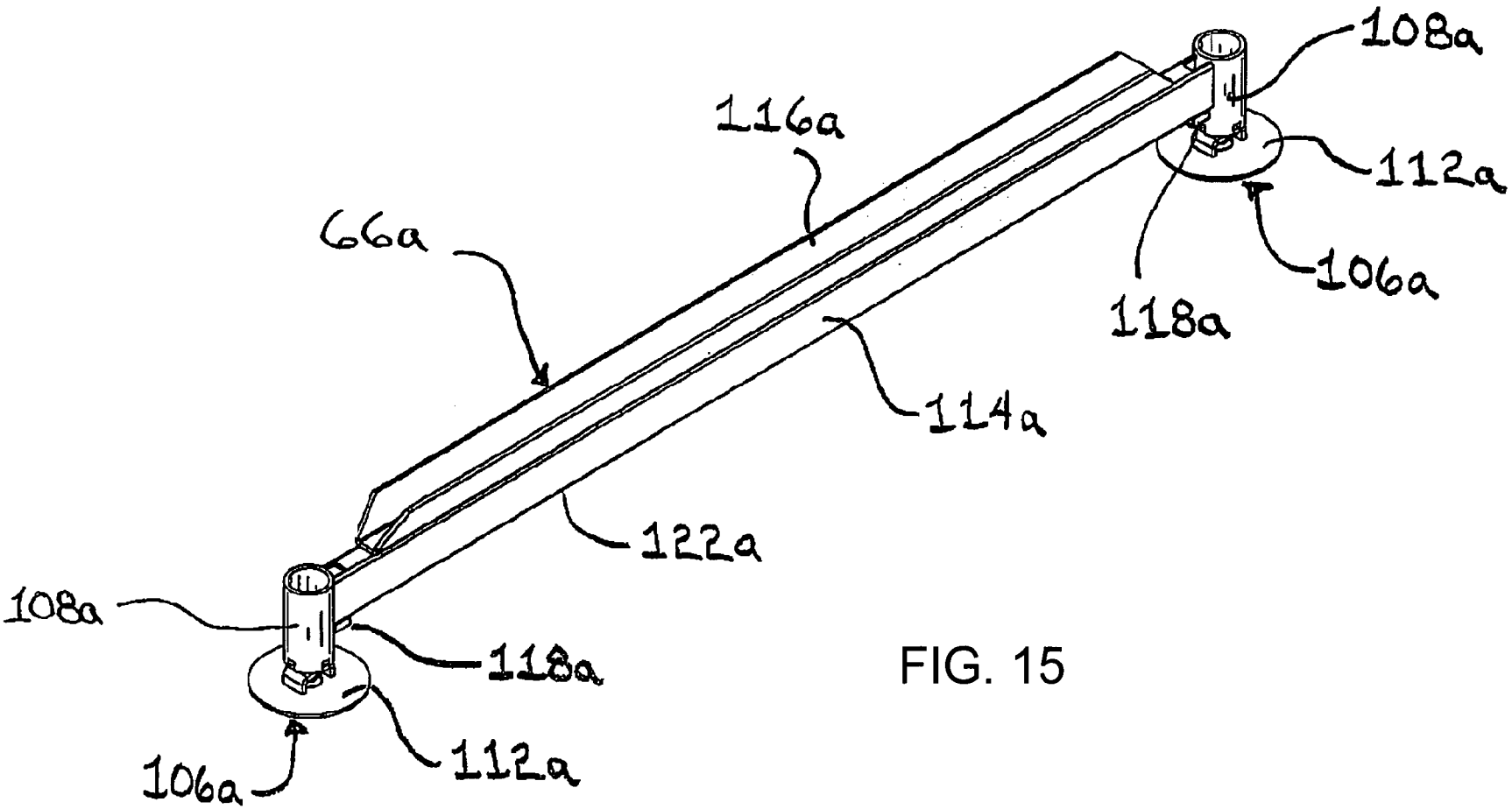
FIG. 15 is a perspective view of a support structure of the wheelchair ramp of FIG. 1.

As noted above and shown in FIGS. 1-3, various support structures 68*a*-68*d*, 67 are used to position and assemble ramp sections 62 of wheelchair ramp 60 in an elevated position. Referring now to FIG. 15, a support structure 66*a* that, as illustrated in FIGS. 1-3, may be used at the connection location of support surface section 62*a* to a straight ramp section 62*c*. Support structure 66*a* includes two pedestal members 106*a* that are each formed as a generally vertically directed and hollow cylinder member 108*a* affixed to a base plate 112*a*. A generally horizontal member 114*a* extends between and is affixed to each of the cylinder members 108*a* and a generally U-shaped receptacle member 116*a* is affixed to the horizontal member 114*a*. A nut 118*a* is mounted on the bottom surface 122*a* of horizontal member 114*a* adjacent each pedestal member 106*a* that is used to secure a clamp member 70 to the support structure 66*a*, as described below. Receptacle member 116*a* is adapted to simultaneously receive the mounting edge 68*a* of support surface section 62*a* and a mounting edge 68*c* of the straight ramp section 62*c* to which the support surface section 62*a* is adjacently assembled. When so received, as described in more detail below in relation to support structure 66*b*, the mounting edges 68*a*, 68*c* are generally aligned and in abutting or adjoining relation such that the support surface section 62*a* and straight ramp section 62*c* may be securely affixed or clamped to the support structure 66*a*.

Figure 16:
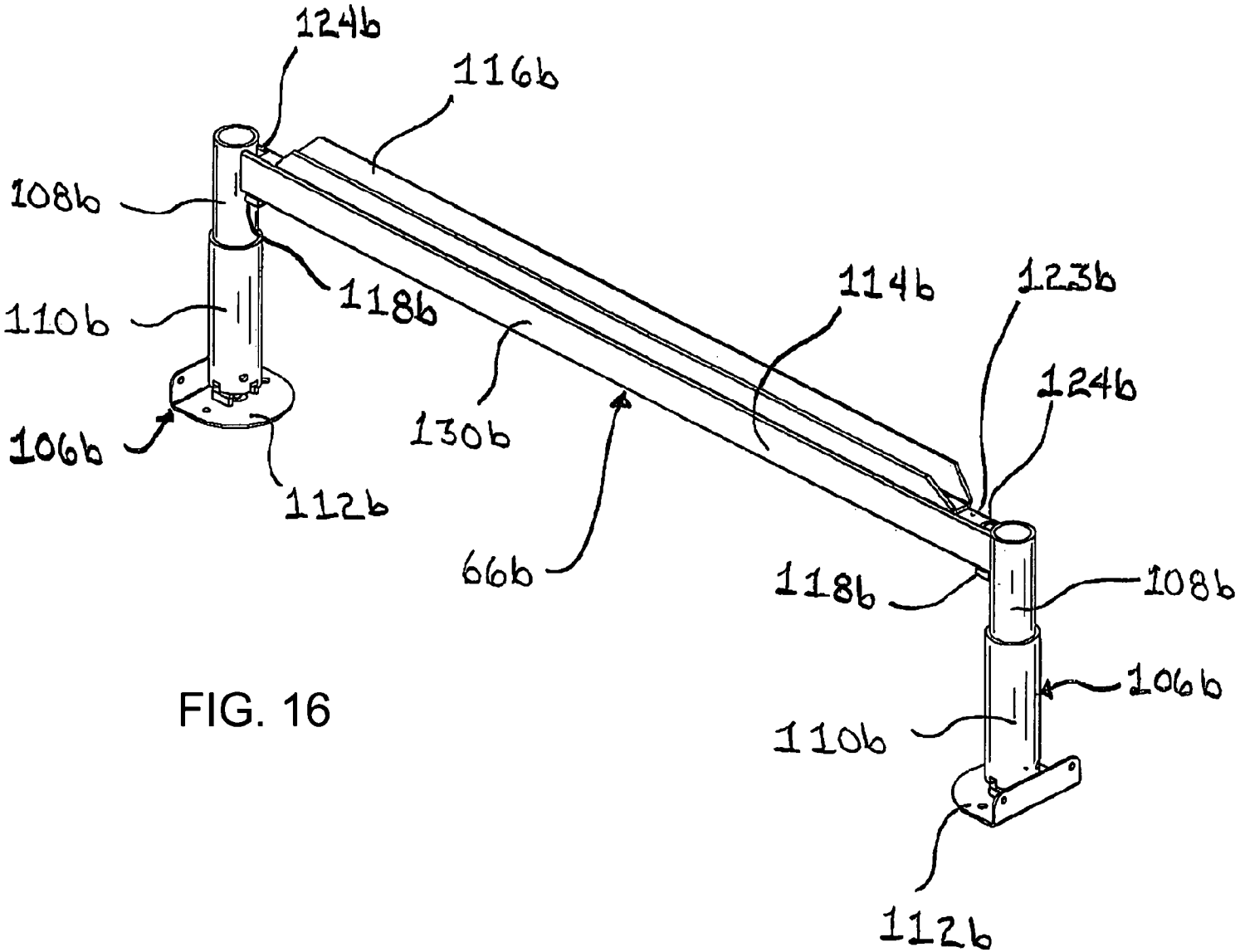
FIG. 16 is a perspective view of another support structure of the wheelchair ramp of FIG. 1.
Figure 17:
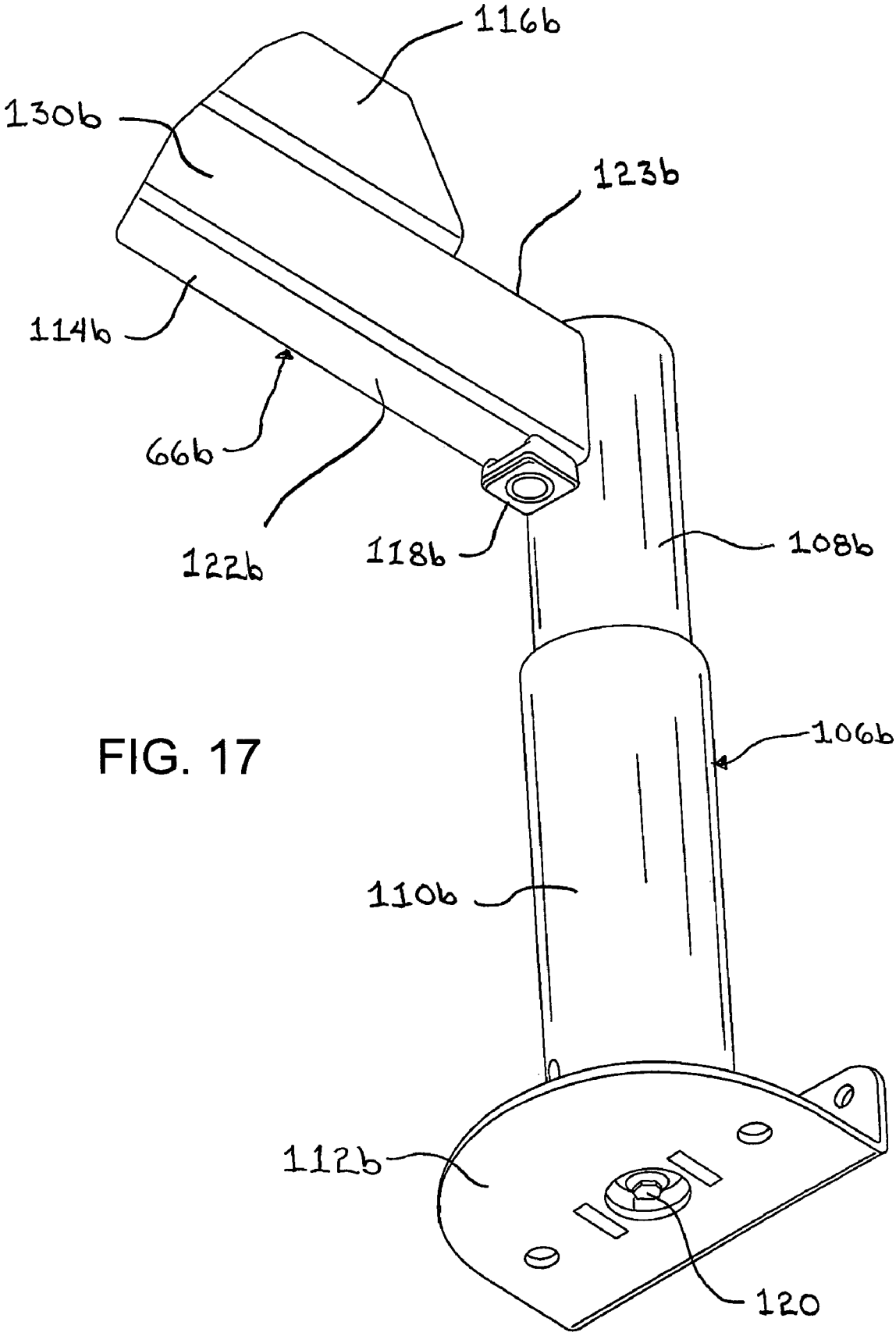
FIG. 17 is a bottom perspective view of a portion of the support structure of FIG. 16.

FIGS. 16 and 17 illustrate a telescoping or adjustable support structure 66*b* that may be used, for example, to receive mounting edges 86*c* of adjacent straight ramp sections 62*c* to position and assemble the straight ramp sections 62*c* of wheelchair ramp 60 in an elevated position as illustrated in FIGS. 1-3. Support structure 66*b* is generally similar to support structure 66*a* noted above, but includes two telescoping pedestal members 106*b* having an upper cylinder member 108*b* that adjustably and telescopically extends and retracts from a lower cylinder member 110*b* mounted to a base plate 112*b*. A generally horizontal member 114*b* extends between the pedestal members 106*b* with a receptacle member 116*b* mounted to the horizontal member 114*b*.

FIG. 17 illustrates a single pedestal member 106*b* of support structure 66*b*, however, it should be appreciated that the opposite pedestal member 106*b* is similarly constructed. As shown, an adjustment screw 120 is provided that is accessible through the base plate 112*b* for extending and retracting upper cylinder member 108*b*. In addition, a nut 118*b* is mounted to the bottom side 122*b* of horizontal member 114*b* adjacent upper cylinder member 108*b*. As understood from the description below, nut 118*b* is accessible by a fastener or screw from the top 123*b* of horizontal member 114*b* via access holes 124*b*.

Although not shown in detail, the support structures 66*c* and 66*d* of FIGS. 1 and 2 are of generally similar construction to support structure 66*b* of FIGS. 16 and 17, but include upper and lower cylinder members that are of generally greater length to enable the ramp sections to be maintained at greater elevations. In addition, support structures 67 are received at mid-support receptacles 92 of curved ramp sections 62*d*. Support structures 67, however, may not include horizontal members and may also only comprise a single telescoping pedestal member with a brace affixed to the upper cylinder.

The receiving of mounting edges 68 by a support structure 66 will now be described with reference to FIG. 18 and the securing of a mounting edge 68*c* of two straight ramp sections 62*c* to a support structure 66*b*. Referring to the mounting edge 68*c* of straight ramp section 62*c* of FIG. 8, the lower edge or lip 126*c* of abutment face 86*c* is adapted to be received within receptacle member 116*b*. When lip 126*c* is so received, the flange 128*c* (FIG. 8) located beneath clamp socket 88*c* extends below receptacle member 116*b* and is positioned generally against or adjacent to a side 130*b* (FIGS. 16 and 17) of horizontal member 114*b*. Further, as illustrated, due to the substantially similar construction of mounting edges 68*c*, when mounting edges 68*c* of adjacent straight ramp sections 62*c* are simultaneously received by receptacle member 116*b* the abutment faces 86*c* of the mounting edges 68*c* are in contact with each other and the clamp sockets 88*c* of the mounting edges 68*c* are aligned. In addition, when so mounted the nut 118*b* located at the bottom side 122*b* horizontal member 114*b* is accessible from above as shown.

Figure 18:
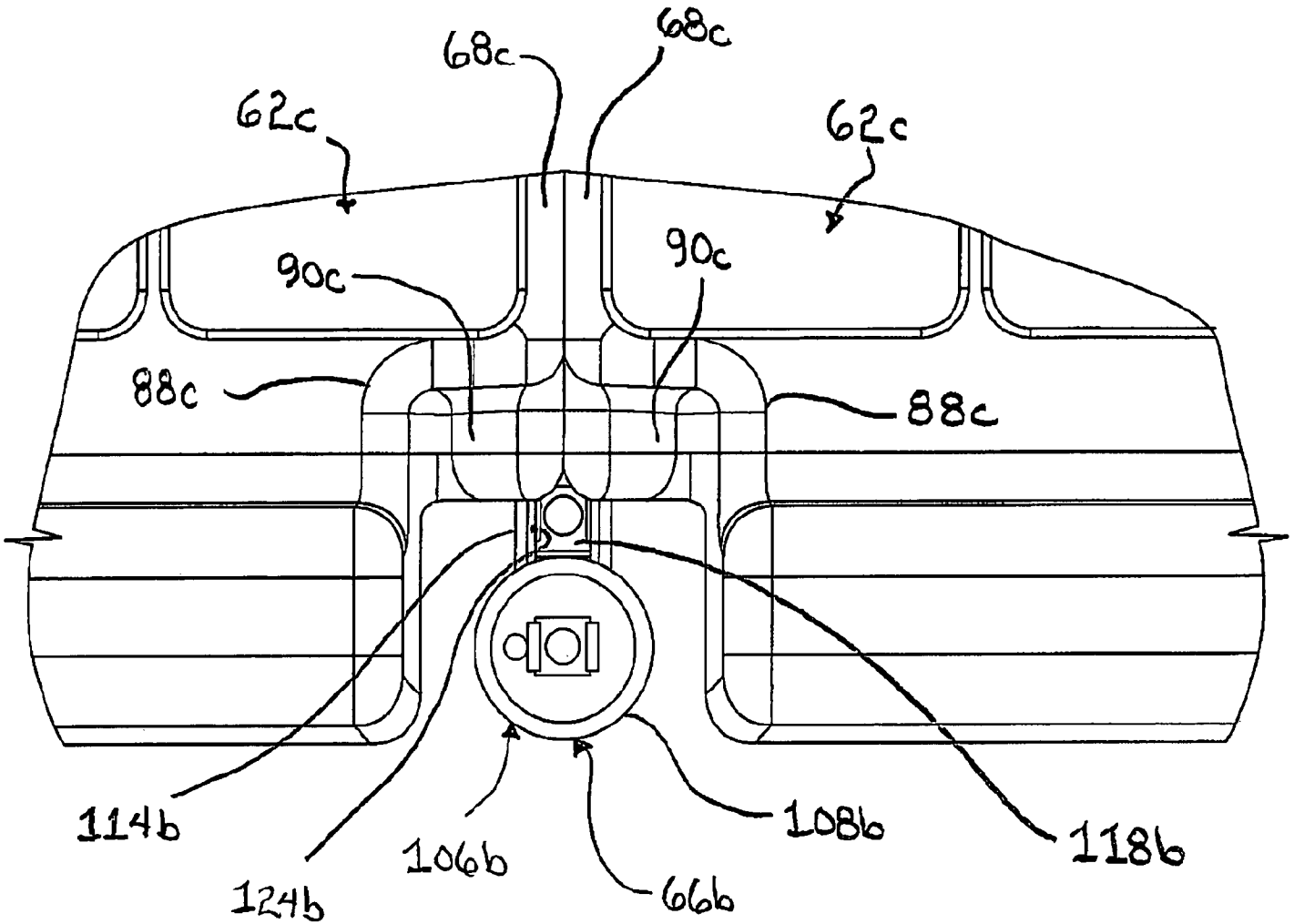
FIG. 18 is a top plan view of a portion of the support structure of FIG. 16 showing portions of straight ramp sections mounted thereto.

Only one pedestal member 106*b* of support structure 66*b* is shown in FIG. 18 in relation to one clamp socket 88*c* of each of two mounting edges 68*c* of straight ramp sections 62*c*. It should be understood that the opposite pedestal member 106*b* and clamp sockets 88*c* are similarly oriented when the mounting edges 68*c* are received by receptacle member 116*b*. Further, it should also be appreciated that the mounting edges 68 of other ramp sections 62, such as mounting edges 68 of curved ramp sections 62*d*, support surface ramp sections 62*a*, platform sections 62*e*, and step sections 62*b*, discussed above, may be similarly received by support structures 66*a*-66*d*.

Figure 19:
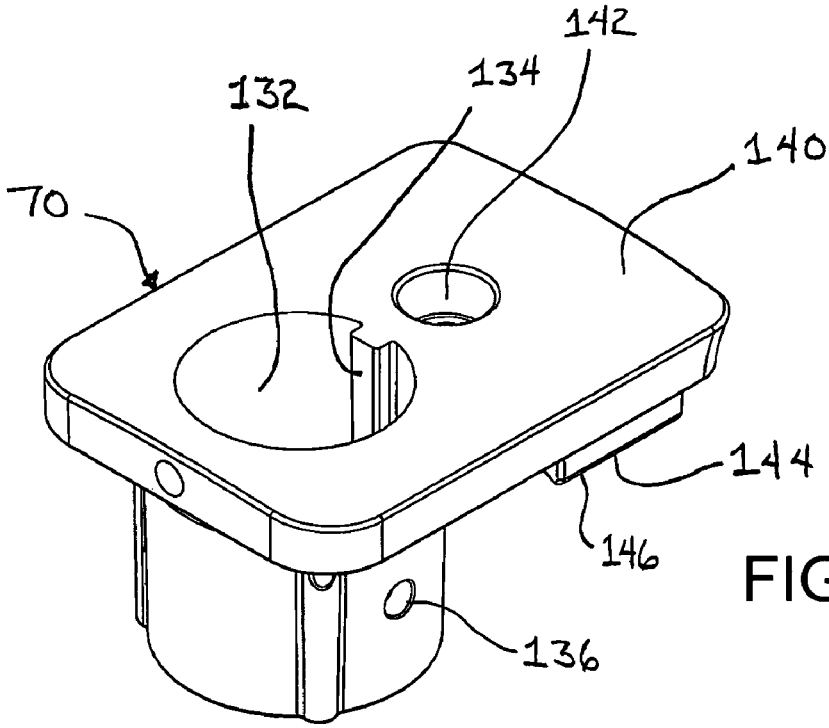
FIG. 19 is a perspective view of a clamp member of the wheelchair ramp of FIG. 1.
Figure 20:
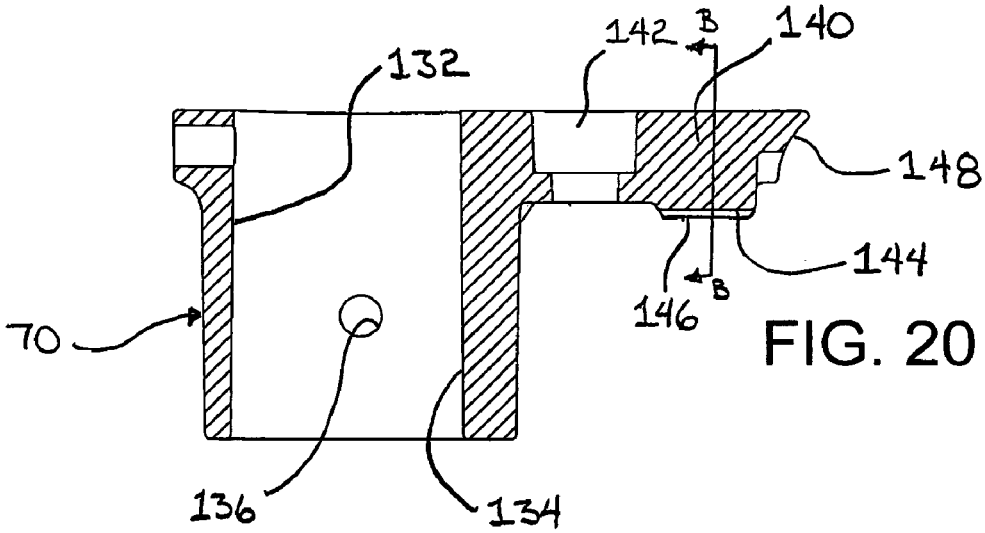
FIG. 20 is a side sectional view of the clamp member of FIG. 19 taken along the center line of FIG. 19.
Figure 21:
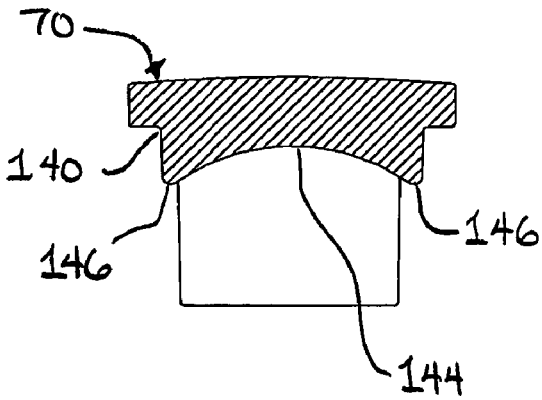
FIG. 21 is a front sectional view of the clamp member of FIG. 19 taken along the line B-B of FIG. 20.
Figure 22:
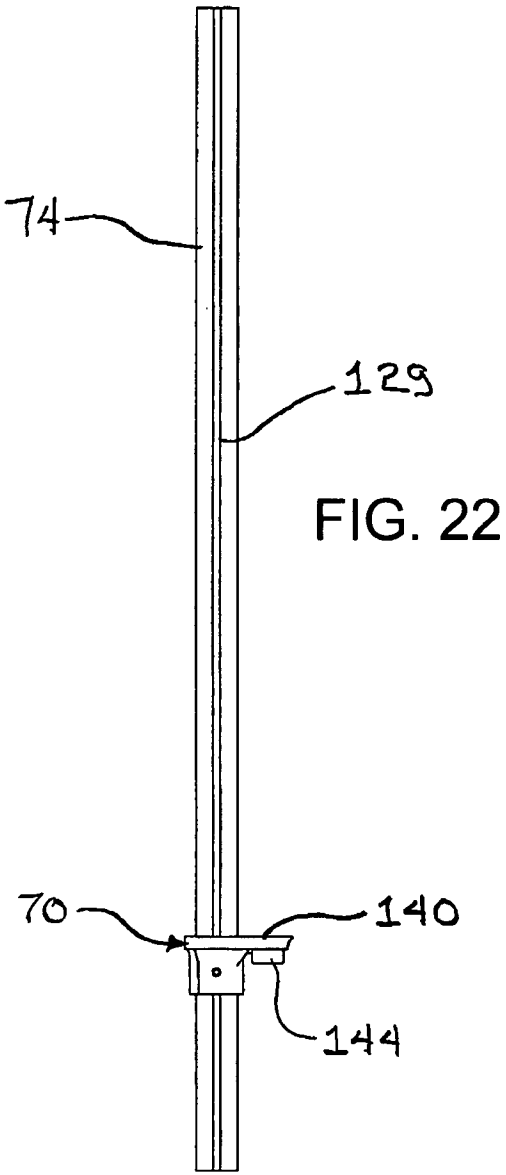
FIG. 22 is a side elevation view of the clamp member of FIG. 19 mounted to a vertical post member.
Figure 23:
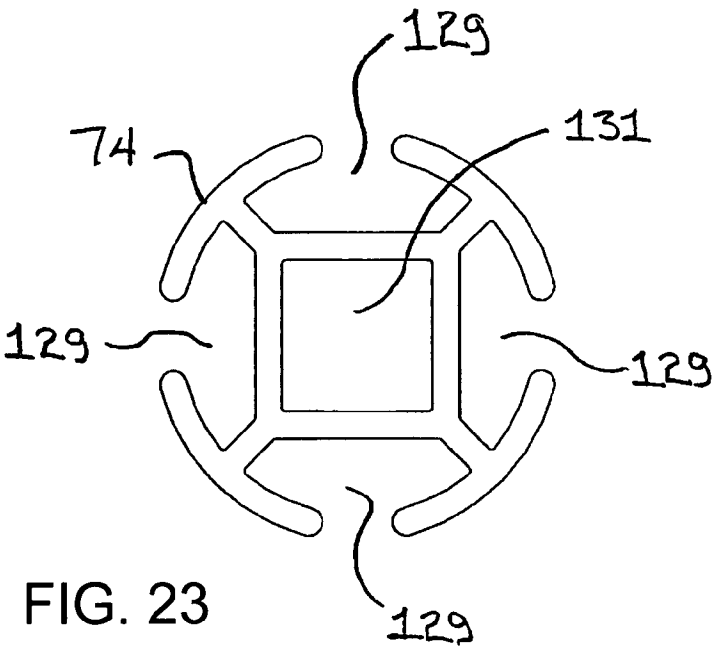
FIG. 23 is an end view of the post member of FIG. 22.
Figure 24:
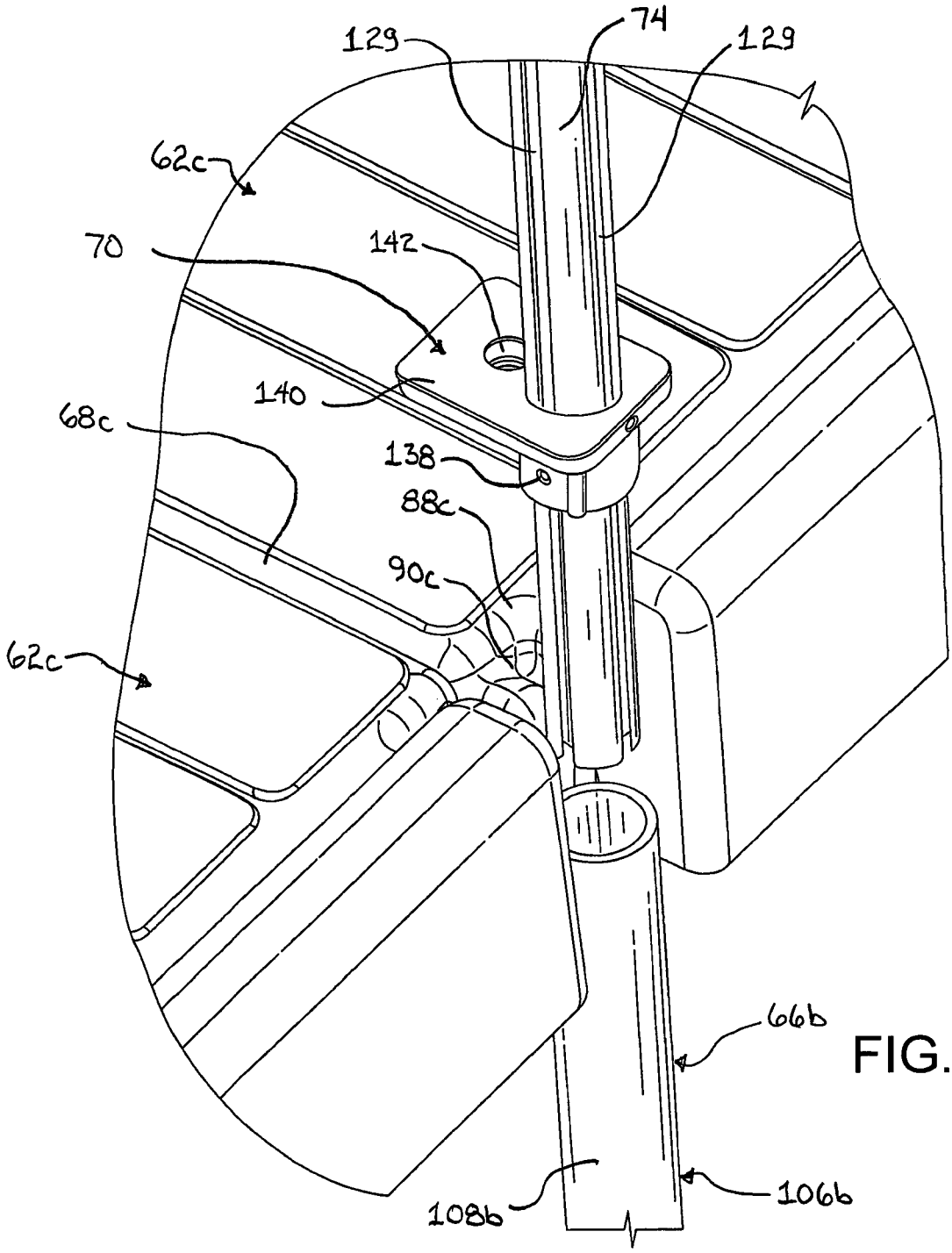
FIG. 24 is a perspective view of the vertical post member and clamp member of FIG. 22 shown in exploded relation to the support structure and straight ramp sections of FIG. 18.
Figure 25:
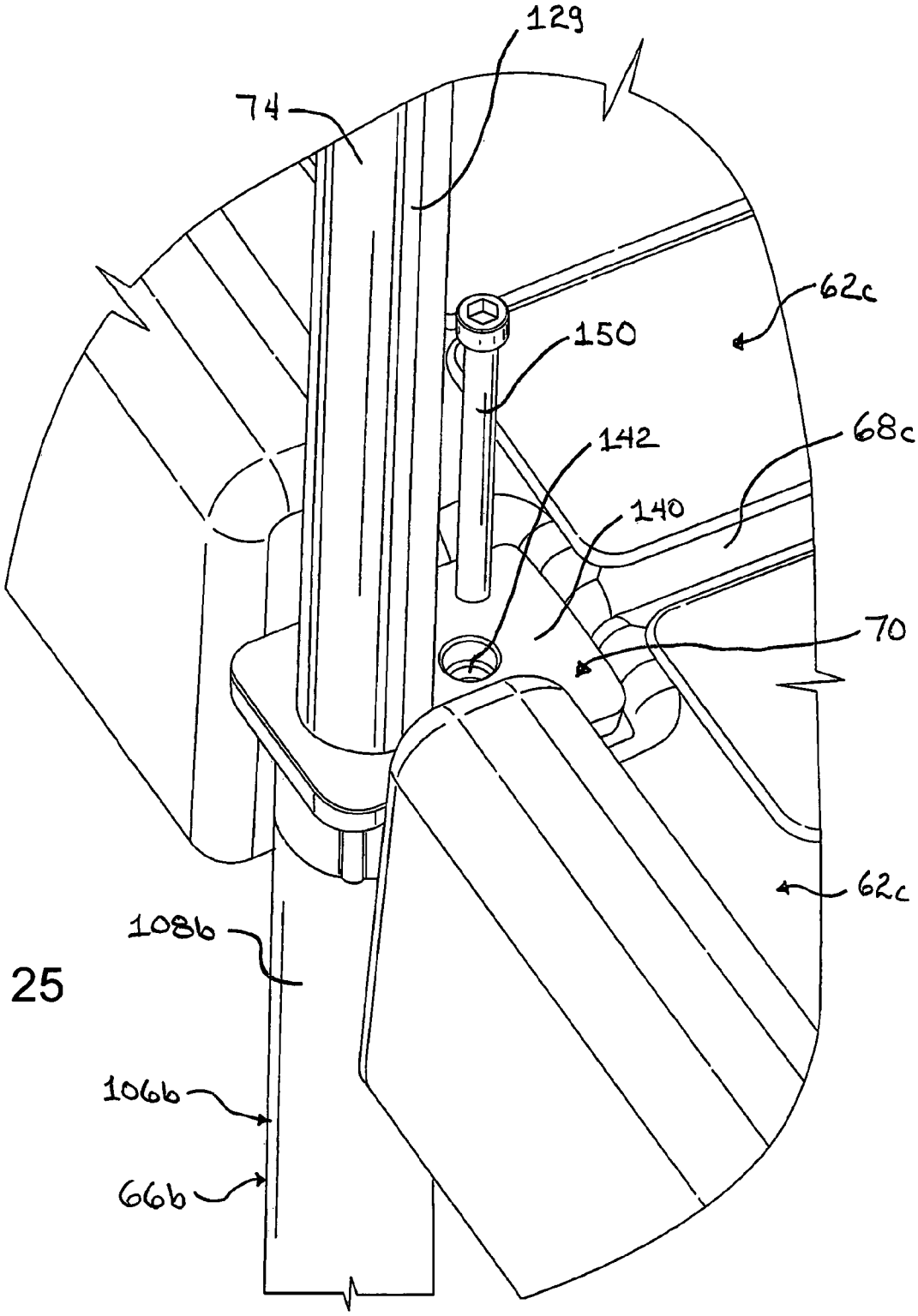
FIG. 25 is an opposite side perspective view of FIG. 24 with the vertical post member installed to the support structure and a fastener shown in exploded relation to the clamp member.
Figure 26:
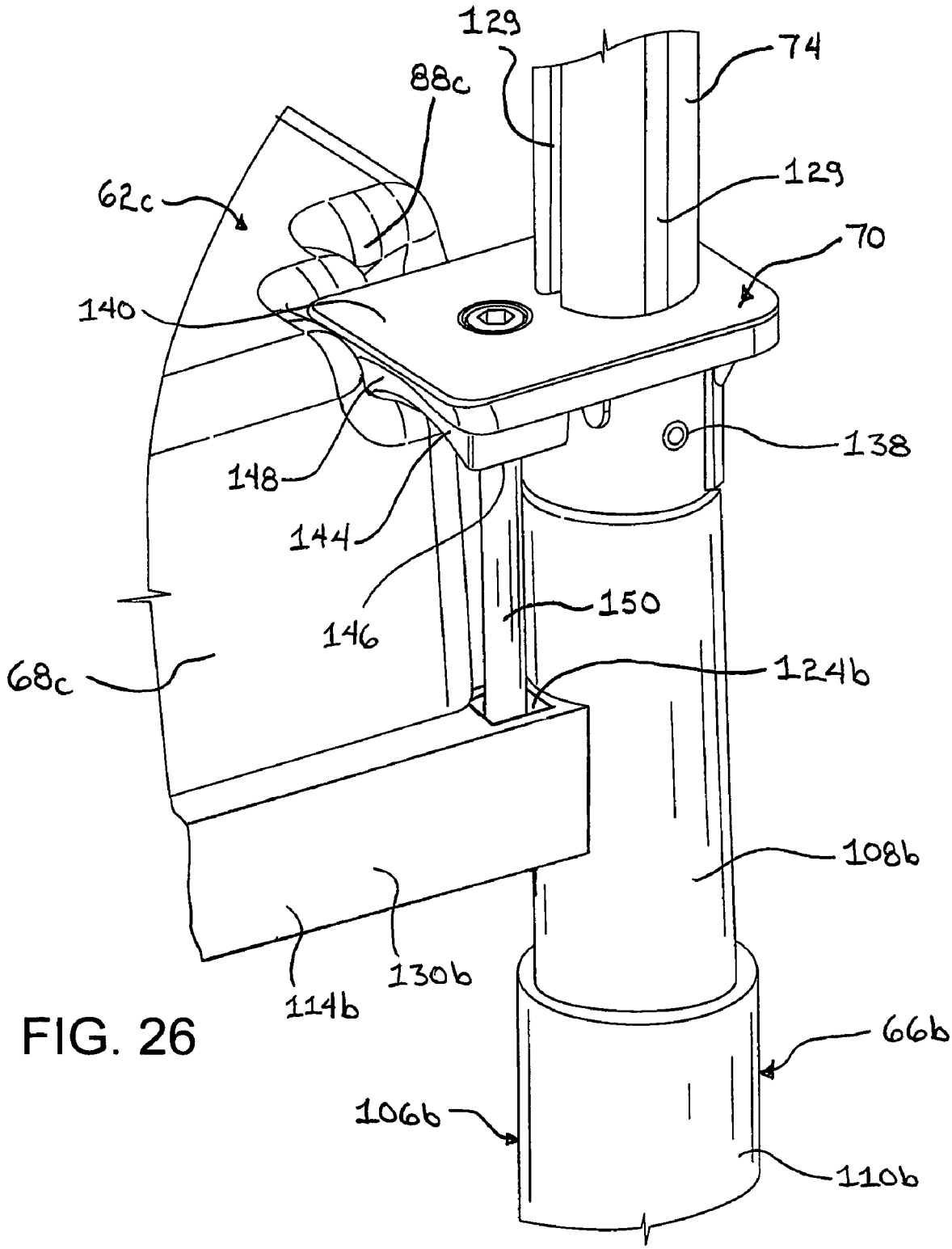
FIG. 26 is a side perspective view of FIG. 25 shown with one straight ramp section removed for clarity and the fastener installed.

Referring now to FIGS. 19-26: FIGS. 19-21 illustrate a clamp member 70 that may be used, as previously noted, to clamp ramp sections 62 that have been received by a receptacle member 116 of a support structure 66 to the support structure 66. In the illustrated embodiment, as shown in FIG. 22, a clamp member 70 may be mounted to a vertical member or post member 74 and, as shown in FIGS. 24-26, the clamp member 70 and post member 74 are then mountable to a support structure 66 with the clamp member 70 being used to clamp ramp sections 62 to the support structure 66, as described in more detail below.

FIG. 23 illustrates an end-view of post member 74. Post member 74 may be formed as an extrusion, such as an aluminum extrusion, and includes four slotted cavities or slots or keyways 129 and a central cavity 131 extending the length of post member 74. FIGS. 19 and 20 disclose that clamp member 70 includes a bore 132 for receiving a post member 74, with bore 132 including a key or protrusion 134. Protrusion 134 is adapted to be received by and slide within one of the slots 129 of post member 74 when post member 74 is inserted into bore 132 such that clamp member 70 is prevented from spinning on post member 74. Clamp member 70 also includes two aligned through holes 136 extending into bore 132 from opposite sides of clamp member 70 for receiving a fastener element 138 (FIGS. 24 and 26), such as a pin, roll pin, or set screws for mounting the clamp member 70 to the post member 74. Although not shown, post member 74 may include two correspondingly longitudinally aligned holes extending into cavity 131 that are adapted to align with the through holes 136 of clamp member 70. In this embodiment, a single fastener element 138 may pass through the holes 136 of clamp member 70 and holes of the post member 74 and securely hold the clamp member 70 to the post member 74 at a set location along the post member 74, as shown in FIG. 22.

Referring again to FIGS. 19-21, clamp member 70 also includes a clamp arm 140 extending in a generally perpendicular orientation relative to bore 132. Clamp arm 140 includes a fastener hole 142, a downwardly arched clamp face 144 having ends 146, and a curved end profile 148. Clamp arm 140, as described in more detail below, is adapted to engage aligned clamp sockets 88 of two mounting edges 68, with clamp face 144 engaging the pockets 90 of the clamp sockets 88.

Referring now to FIGS. 24-26, post member 74 with the attached clamp member 70 is adapted to be inserted into the upper cylinder member 108*b* of a support structure 66*b* pedestal member 106*b*. Although not shown, the inner circumference of the upper cylinder member 108*b* may include one or more keys, or the like, for extending into one or more of the slots 129 of the post member 74 to provide alignment guidance and/or prevent the post member 74 from spinning within the upper cylinder member 108*b*.

As shown in FIG. 25, post member 74 is lowered into upper cylinder member 108*b* until clamp arm 140 contacts the clamp sockets 88*c* of the adjoined straight ramp sections 62*c*. In the illustrated embodiment, when so installed, clamp member 70 may also contact upper cylinder member 108*b*. It should be appreciated, however, that a clamp member 70 may alternatively not contact an upper cylinder member 108*b* and the clamp member 70 may still be used to securely clamp mounting edges 68*c* to support structure 66*b*. When clamp arm 140 engages clamp sockets 88*c* as described, one of the ends 146 of clamp face 144 is positioned within a pocket 90*c* of a clamp socket 88*c* of one of the mounting edges 68*c* and the other end 146 is within the pocket 90*c* of the clamp socket 88*c* of the adjacent mounting edge 68*c*. Further, when so engaged, the fastener hole 142 of clamp arm 140 is aligned with the access hole 124*b* and nut 118*b* of the support structure 66*b*, which are shown in alignment in FIG. 18. As such, a fastener 150, such as threaded fastener, may be passed through the fastener hole 142 and threaded into engagement with nut 118*b* and used to tighten clamp arm 140 against the adjacent clamp sockets 88*c*. The arched nature of clamp face 144 and the interaction of ends 146 with pockets 90*c* of clamp sockets 88*c* causes the adjacent mounting edges 68*c* to be drawn into compressed engagement with each other. A support structure 66 to which is mounted two clamp members 70 and associated post members 74 thus defines a generally H-shaped support structure.

Although the above discussed assembly and clamping of mounting edges to a support structure is done with reference to mounting edges 68*c* of adjacent straight ramp sections 62*c* and a support structure 66*b*, it should be appreciated that the same assembly and clamping technique may be used to secure any arrangement of the other discussed mounting edges 68*a*-68*f* of ramp sections 62*a*-62*f* to support structures 66*a*-66*d*.

Vertical members or post members 74 may be used to form rail assemblies 72*a*, 72*b* shown in FIGS. 1-3. The above description illustrates the affixing of post members 74 to support structures 66, 67. In addition, however, as described below in reference to FIGS. 27-30, post members 74 may also be mounted to the ends of the wheelchair ramp, such as to the support surface section 62*a* (FIGS. 27-28) and to the step section 62*b* (FIGS. 29-30).

Figure 27:
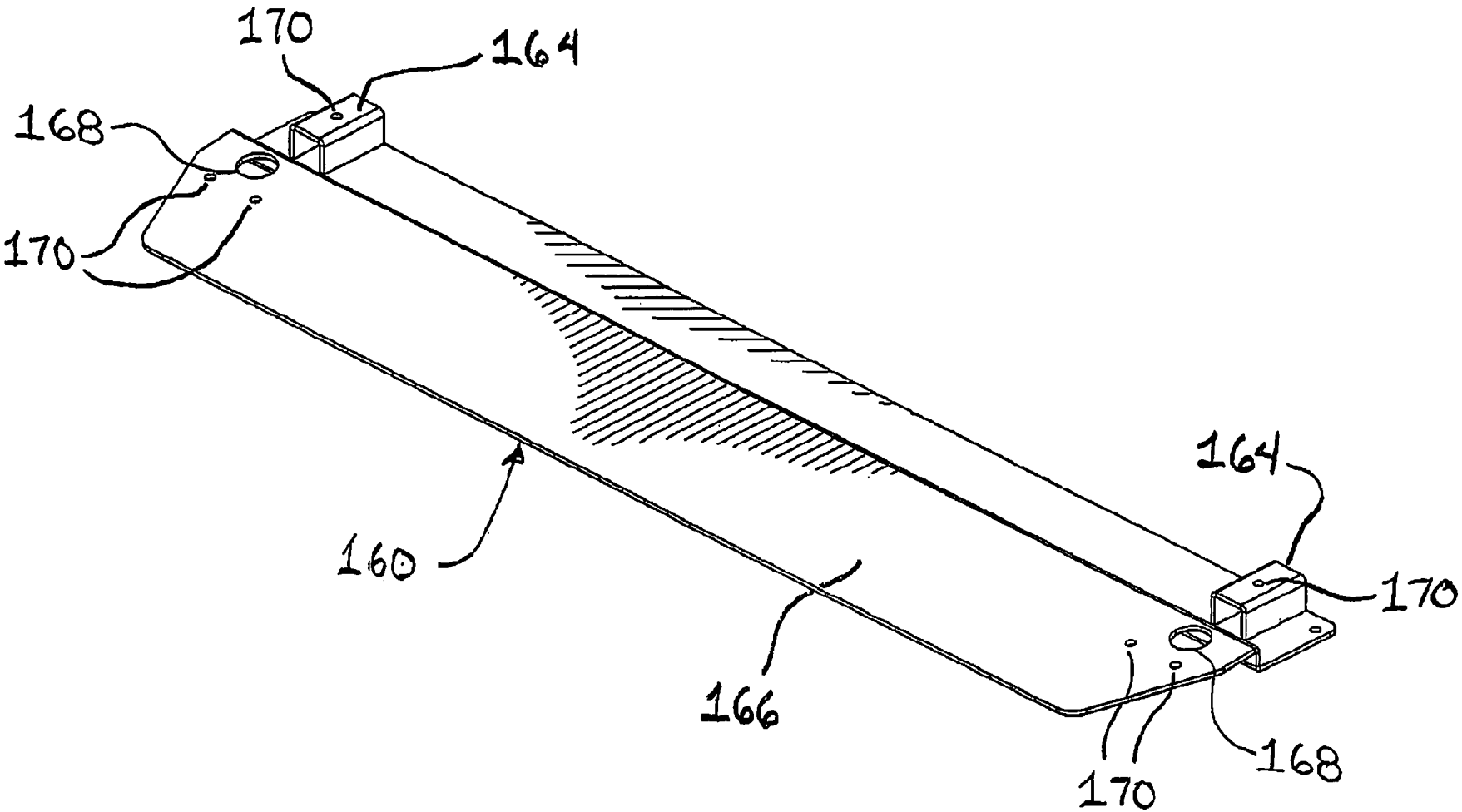
FIG. 27 is a perspective view of a bracket for use with the support surface section of FIG. 11.
Figure 28:
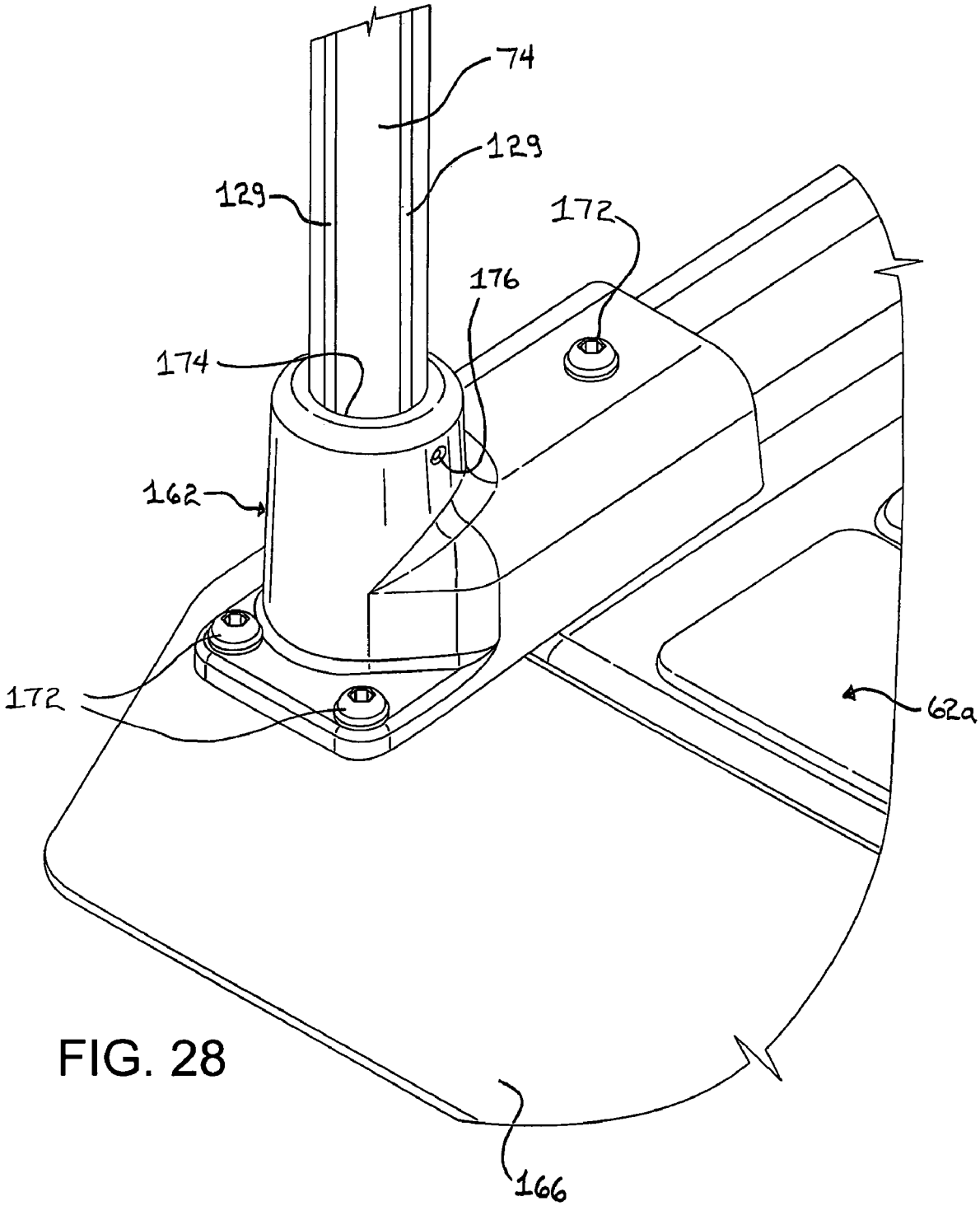
FIG. 28 is a perspective view of a portion of the bracket of FIG. 27 shown affixed to the support surface section of FIG. 11 with a vertical post member bracket mounted thereto and receiving a vertical post member.

Referring now to FIGS. 27 and 28, a ramp bracket 160 and post bracket 162 are illustrated that may be used to mount post members 74 to or at the support surface section 62*a*. Ramp bracket 160 includes braces 164 adapted to be positioned under the side edges 84*a* of support surface section 62*a* with a tongue 166 extending outward from the support surface section 62*a*. Tongue 166 also includes holes 168 for receiving post members 74 and holes 170 for receiving fasteners 172 to secure the ramp bracket 160, post bracket 162, and support surface section 62*a* together. FIG. 28 illustrates one corner of a ramp bracket 160 and a post bracket 162 assembled to a support surface section 62*a*. As shown, with braces 164 positioned beneath side edge 84*a*, post bracket 162 may be positioned overtop of side edge 84*a* above braces 164 with a portion of post bracket 162 engaging tongue 166. Fasteners 172 may then be used to secure post bracket 162 to ramp bracket 160 with a portion of the side edge 84*a* sandwiched there between. Post bracket 162 also includes a post hole 174 for receiving a post member 74, which may extend into holes 168 of tongue 166. Finally, a set screw or pin 176, or the like, may be used to secure post member 74 within post bracket 162.

Figure 29:
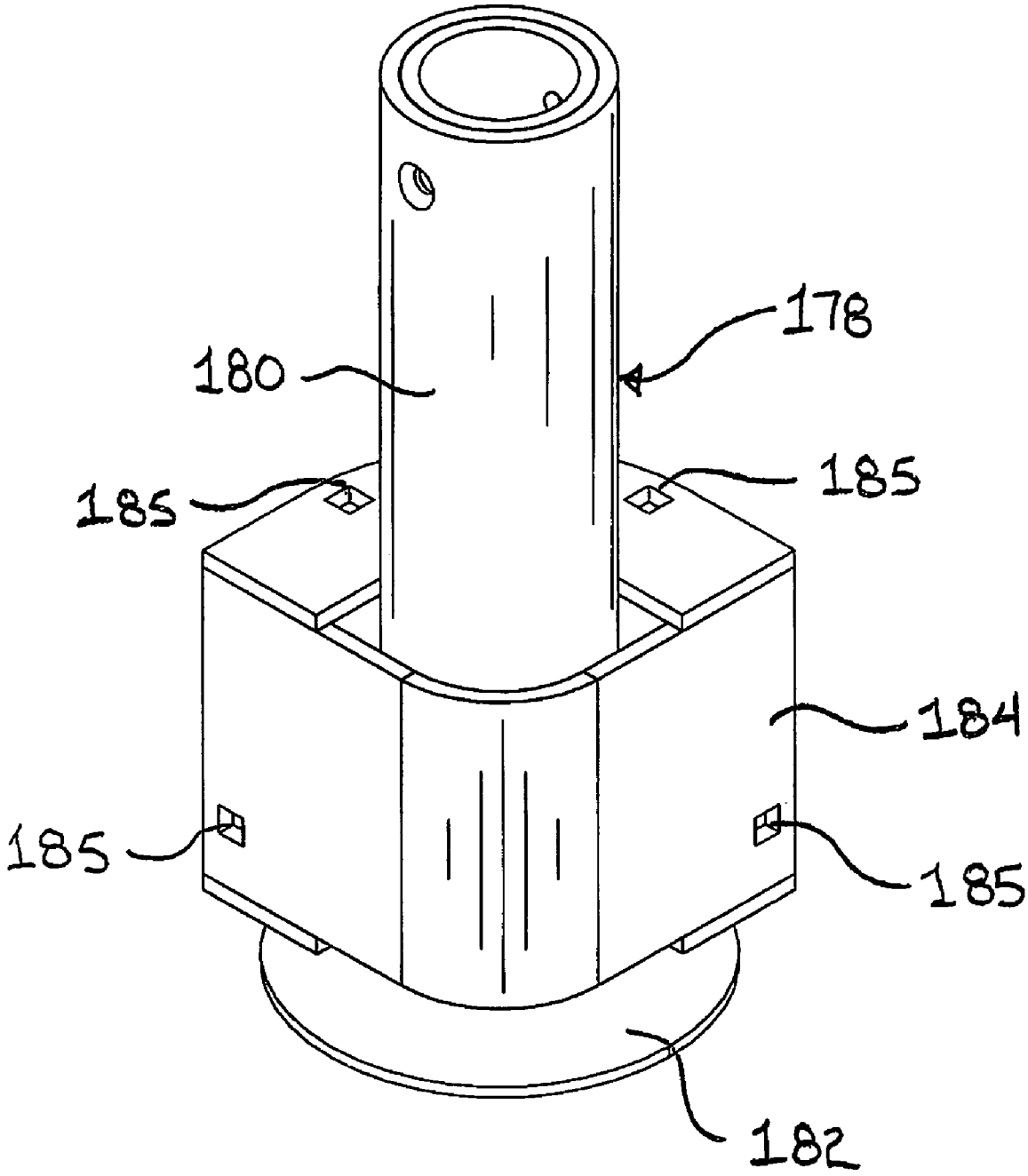
FIG. 29 is a perspective view of a bracket member for use with the step section of FIG. 14.
Figure 30:
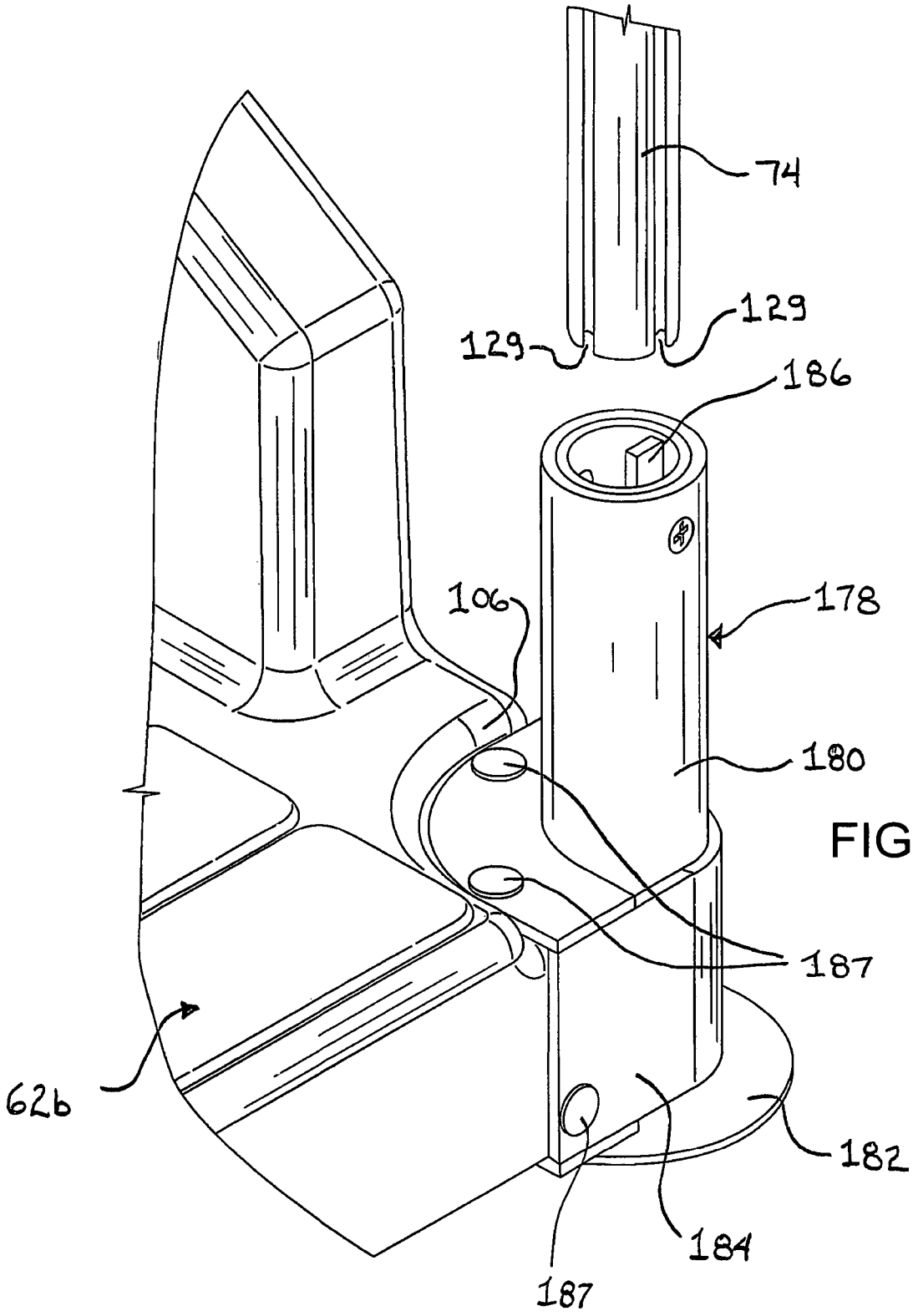
FIG. 30 is a perspective view of the bracket member of FIG. 29 shown mounted to the step section of FIG. 14 with a vertical post member in exploded relation to the bracket member.

Referring now to FIGS. 29 and 30, a post bracket 178 is illustrated that may be used to mount post members 74 to or at the post receiving portion 106 of step section 62*b*. Post bracket 178 includes a hollow cylindrical member 180 for receiving a post member 74 and includes a lower base plate 182 and brace 184. In addition, as shown in FIG. 30, the inner circumference of the cylindrical member may include a key 186, or the like, for extending into one or more of the slots 129 of the post member 74 to provide alignment guidance and/or prevent the post member 74 from spinning within the cylindrical member 180. Brace 184 of post bracket 178 also includes holes 185 for receiving fasteners 187 and the base plate 182 is adapted for engaging the support surface upon which wheelchair ramp 60 is mounted. Although a single bracket 178 and post receiving portion 106 of step section 62*a* are illustrated in FIG. 30, a bracket 178 is adapted to be mounted to each of the two post receiving portions 106 of step section 62*a*.

Railing assemblies 72*a*, 72*b*, as shown in FIGS. 1-3, in addition to post members 74 also include various railing components extending between adjacent post members 74, with one type of railing component being horizontal rail members oriented as lower rail members 78 and upper rail members 76.

Figure 31:
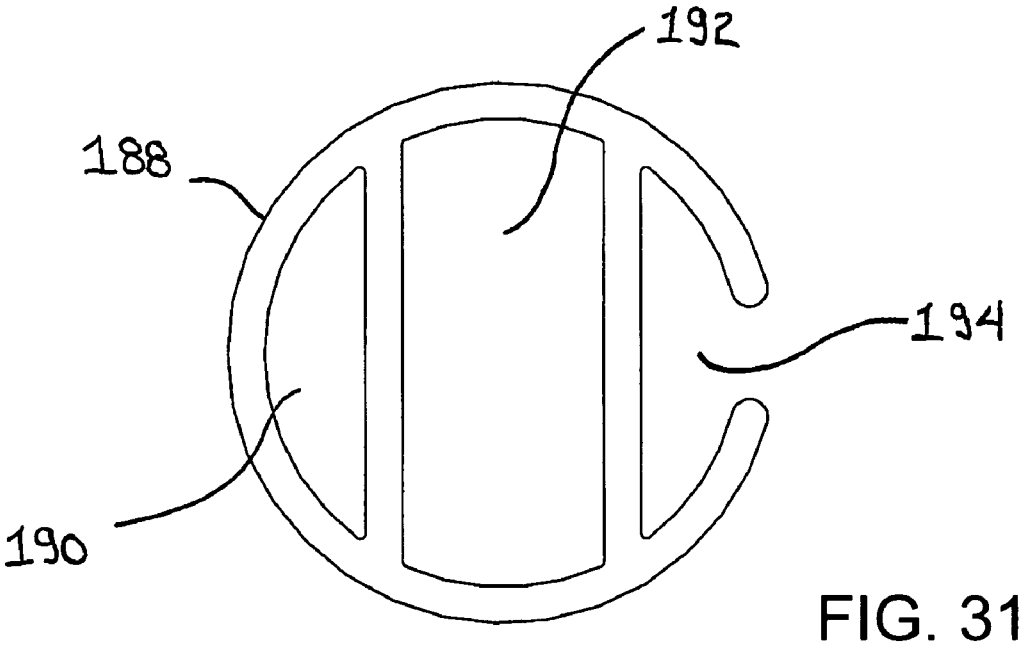
FIG. 31 is an end view of a horizontal rail member of the wheelchair ramp of FIG. 1.

Referring now to FIGS. 31-46: In the illustrated embodiment of wheelchair ramp 60, upper and lower rail members 76, 78 are substantially similar, and include an elongate rod 188 that may be formed as an aluminum extrusion that is cut or formed in predetermined lengths for assembly between adjacent post members 74. FIG. 31 illustrates the end profile view of the elongate rod 188 and discloses the inclusion of an enclosed side cavity 190 and central cavity 192, and a slot or slotted side cavity 194. Various insert members or extensions, such as the extensions 196, 210, 224 illustrated in FIGS. 32-34 and described below, are mounted to rods 188 to enable rods to be mounted to post members 74.

Figure 32:
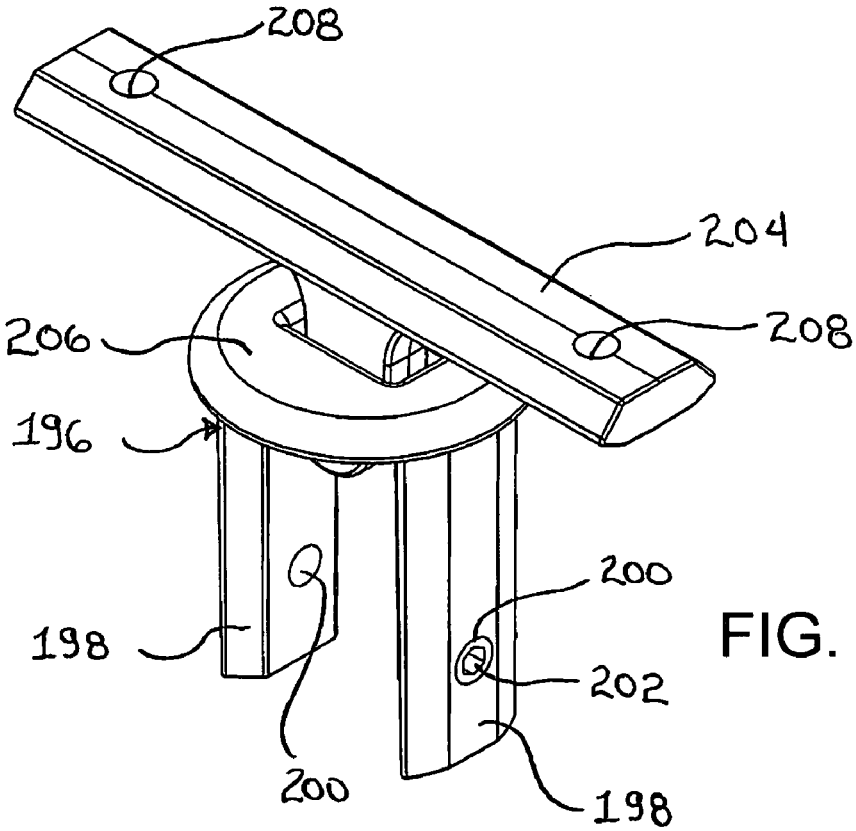
FIG. 32 is a perspective view of an insert member for use with the horizontal rail member of FIG. 31.

The insert member or extension 196 of FIG. 32 includes legs 198 that are adapted to be inserted into the side cavities 190, 194 of rod 188. Legs 198 of extension 196 include holes 200 for receiving set screws 202 (one shown). When legs 198 are inserted into side cavities 190, 194, it should be appreciated that one of the legs 198 will be accessible through slot 194 such that a set screw 202 may be used to secure extension 196 to the end of rod 188. Extension 196 also includes a pivoting T-member 204 extending from cap 206 from which legs 198 extend in the opposite direction. As described in more detail below in regard to extension 210 of FIG. 33, T-member 204, which is adapted to pivot relative to cap 206, is adapted for installation into a slot 129 of a post member 74. T-member 204 includes holes 208 for receiving set screws to thereby secure the extension 196 to a post member 74 in a desired position.

Figure 33:
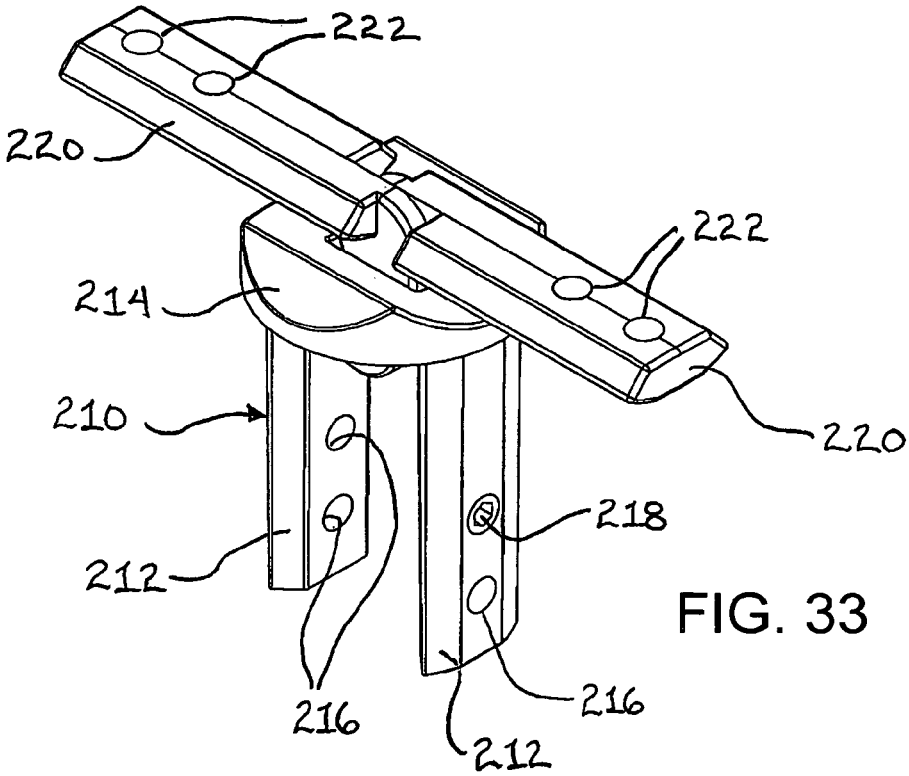
FIG. 33 is an alternative insert member for use with the horizontal rail member of FIG. 31.
Figure 35:
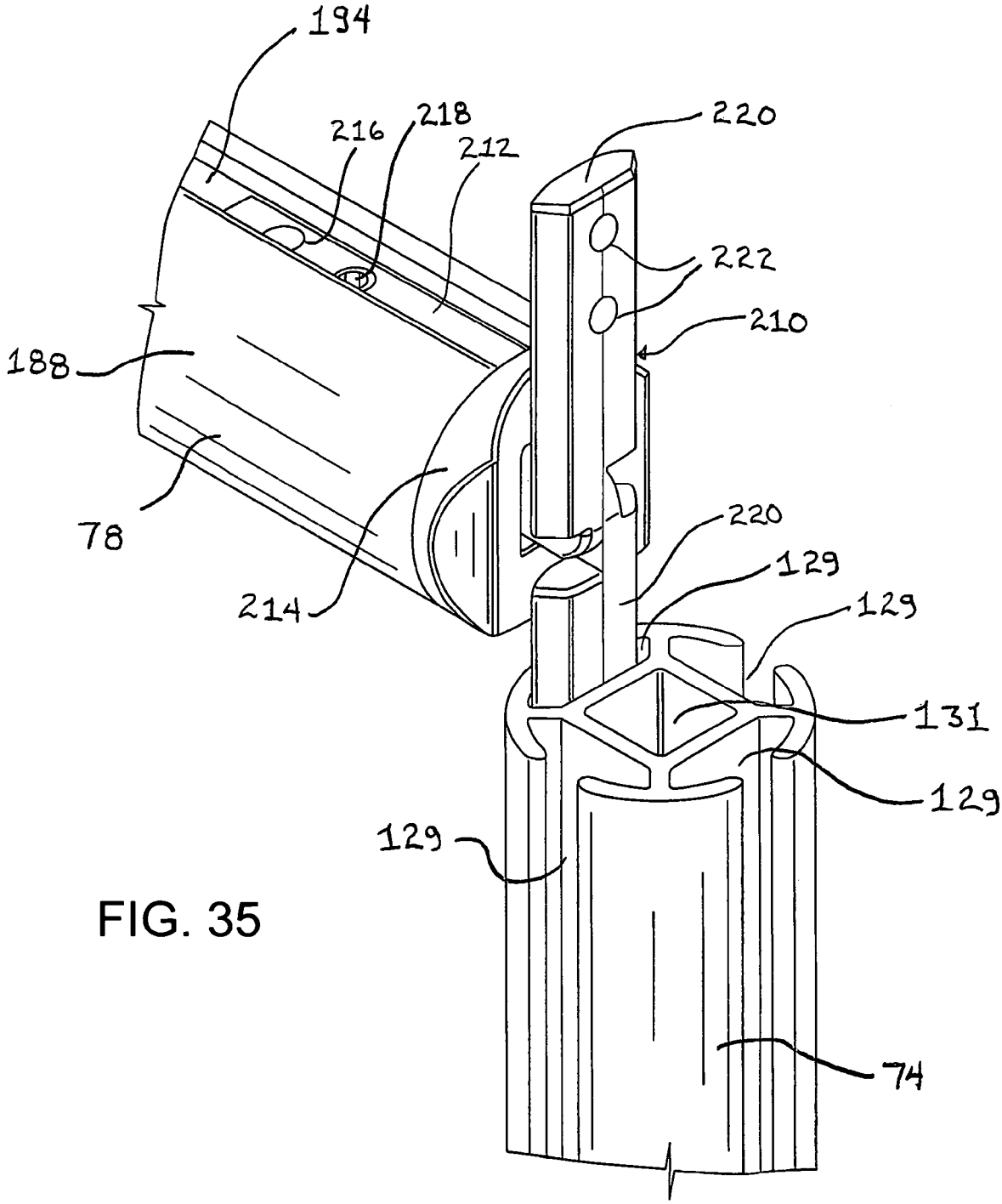
FIG. 35 is a perspective view of the insert member of FIG. 33 shown installed to a horizontal rail member being assembled to a vertical post member.

Referring now to FIGS. 33 and 35, an alternative insert member or extension 210 is shown that is of generally similar construction to extension 196 of FIG. 32. Extension 210 includes legs 212 extending from cap 214 and includes holes 216 for receiving set screws 218 to secure extension 210 to a rod 188. Extension 210, however, includes two pivoting arms 220, each of which includes holes 222 for receiving set screws or pins or the like and which are adapted to be inserted into a slot 129 of a post member 74, as shown in FIG. 35.

In the illustrated embodiment, extensions 196 and 210 are adapted for use with rods 188 to form lower rail members 78. As shown in FIG. 35, a rod 188 having extensions 210 affixed to each end of the rod 188 (only one shown in FIG. 35) is adapted to be lowered from the upper open ends of adjacent post members 74 into a predetermined position, as shown in FIGS. 1 and 2. When so assembled to post members 74, the slot 194 of rod 188 is intended to be directed upward to enable flexible wall assemblies 80 to be mounted thereto as described below. The ability of T-member 204 of extension 196 to pivot relative to cap 206 and the ability of arms 220 of extension 210 to pivot relative to cap 214 provides ease of sliding assembly of lower rail member 78 to adjacent post members 74 when being lowered into place. For example, rod 188 of lower rail member 78 may pivot or become cocked while being lowered into place and the above noted pivoting ability of extensions 196, 210 may prevent lower rail member 78 from binding during such assembly. Further, the pivoting nature allows the lower rail member 78 to be angled, such as at the same angle of inclination of the wheelchair ramp 60, relative to the generally vertically oriented post members 74.

Figure 34:
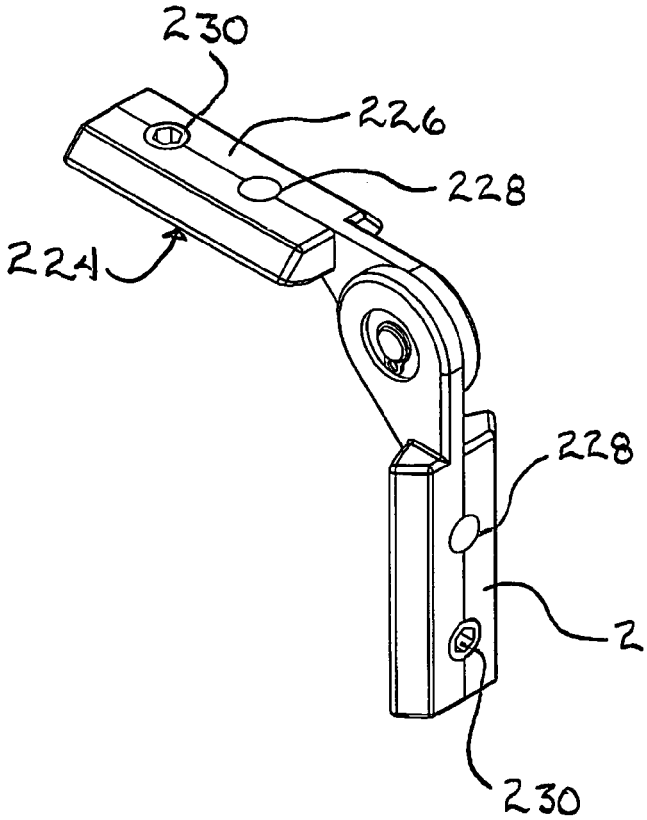
FIG. 34 is a perspective view of another insert member for use with the horizontal rail member of FIG. 31.
Figure 36:
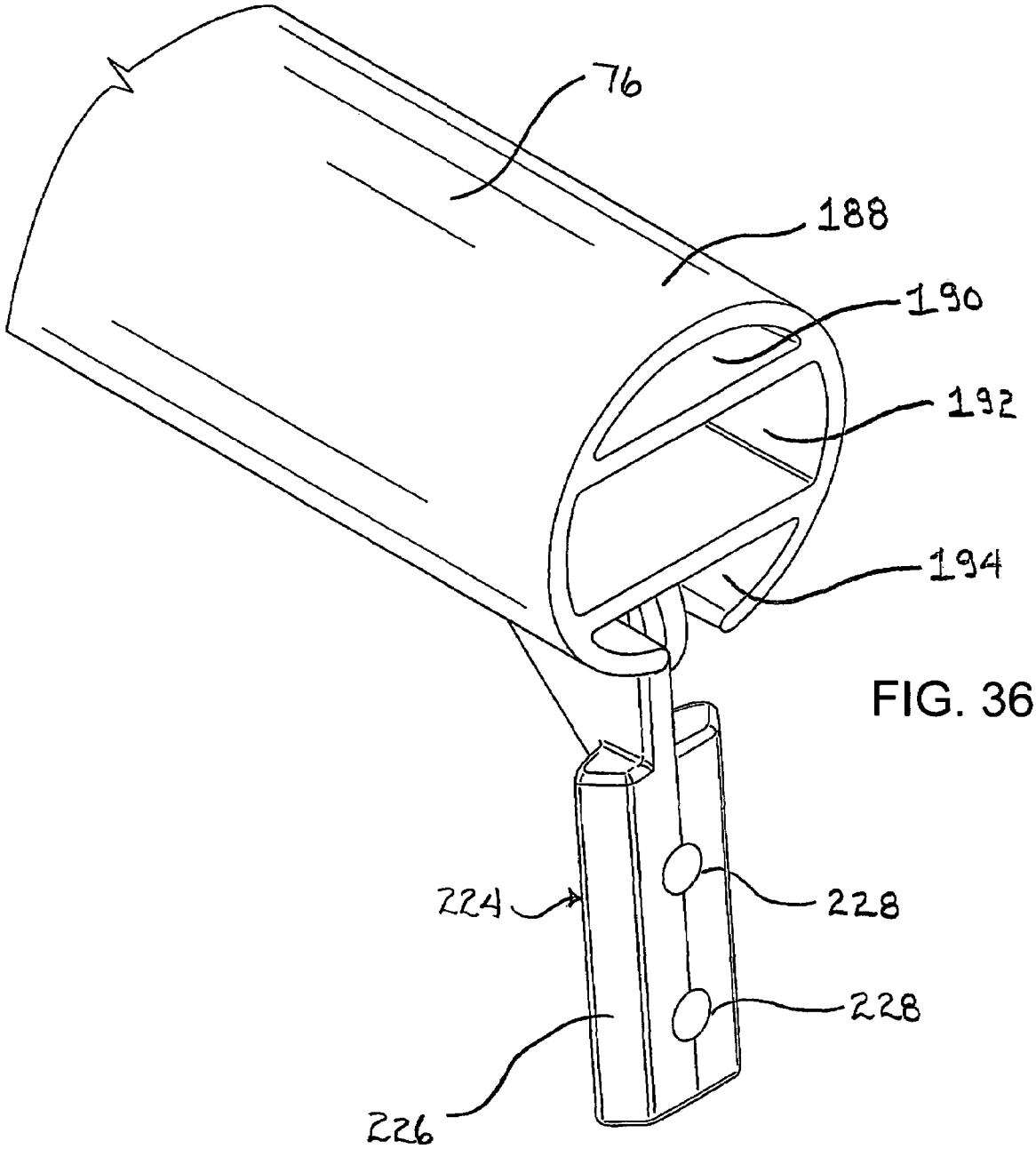
FIG. 36 is a perspective view of the insert member of FIG. 34 inserted to a horizontal rail member.
Figure 37:
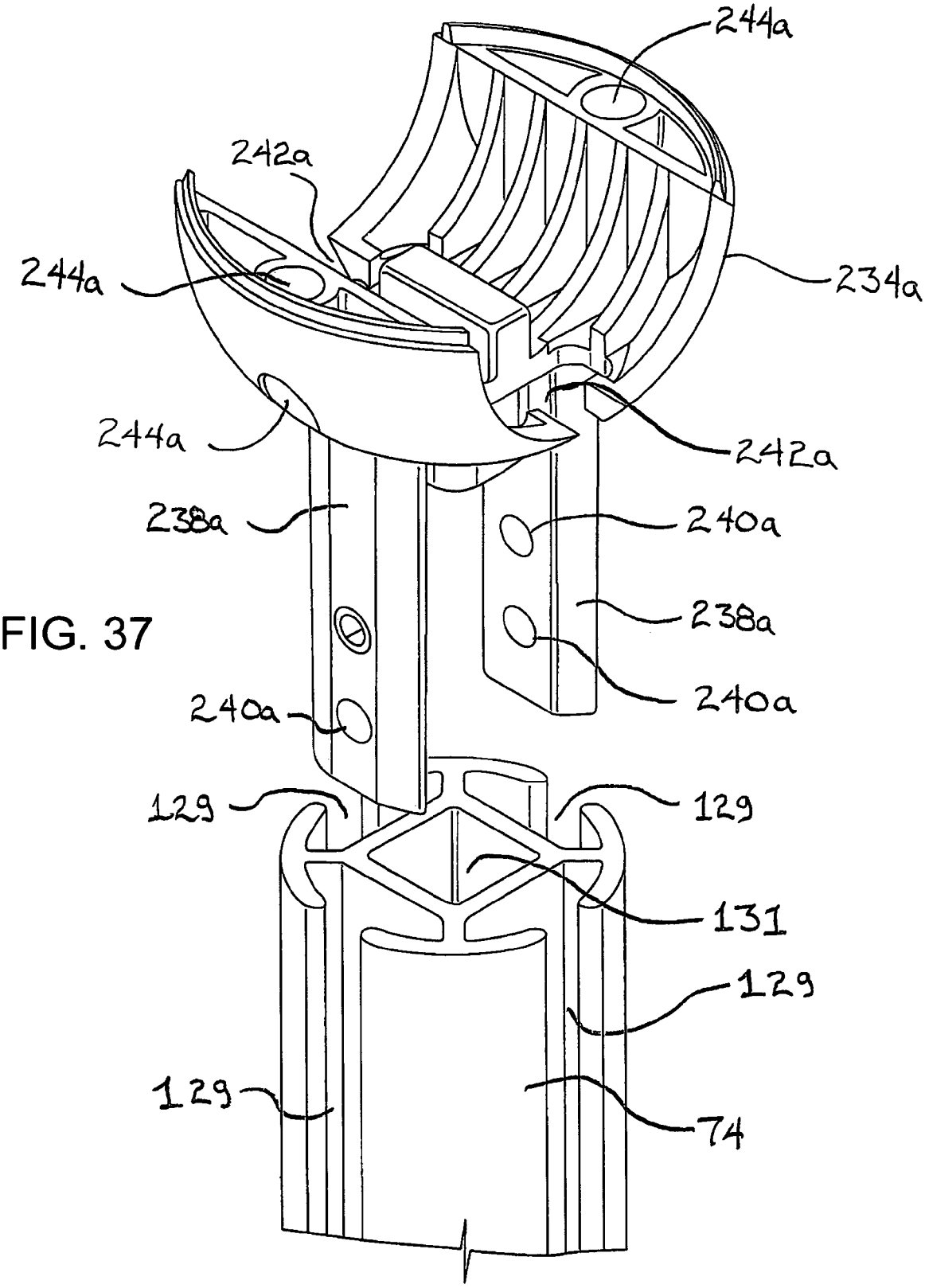
FIG. 37 is an exploded perspective view of a portion of a ball cap member in relation to a vertical post member.

Referring now to FIGS. 34 and 36, an insert member or extension 224 is shown that is intended for use in the illustrated embodiment with upper rail members 76. Extension 224 includes two legs 226 that are pivotally joined together. One of either of the two legs 226 is intended for insertion into slot 194 of rod 188 such that the other leg 226 may be inserted into one of the slots 129 of a post member 74. Each leg 226 includes holes 228 that are accessible when mounted to slots 129, 194 of a post member 74 or rod 188 for receiving set screws or pins 230 to secure the extension 224 in place. Although FIG. 36 only illustrates a single extension 224 at an end of rod 188 of upper rail member 76, it should be appreciated that an extension 224 may be inserted at both ends in similar manner to that shown. The ability of legs 226 of extension 224 to pivot relative to each other enables an upper rail member 76 to be angled, such as at the same angle of inclination of the wheelchair ramp 60, relative to the generally vertically oriented post members 74, and provides ease of assembly.

Figure 38:
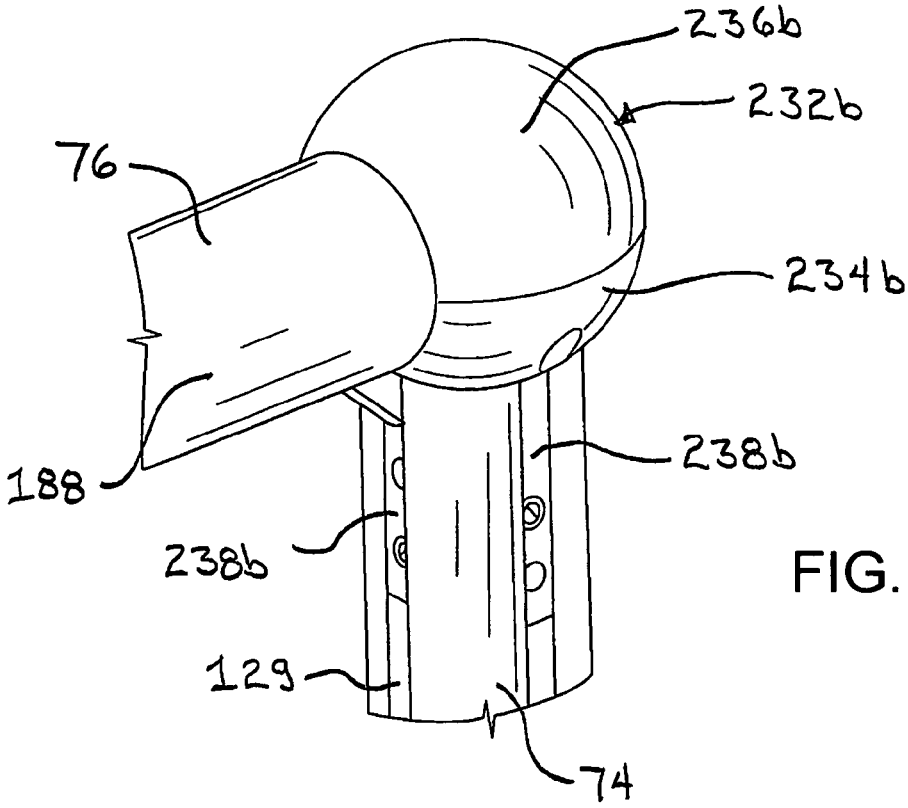
FIG. 38 is a perspective view of an assembled ball cap member.
Figure 39:
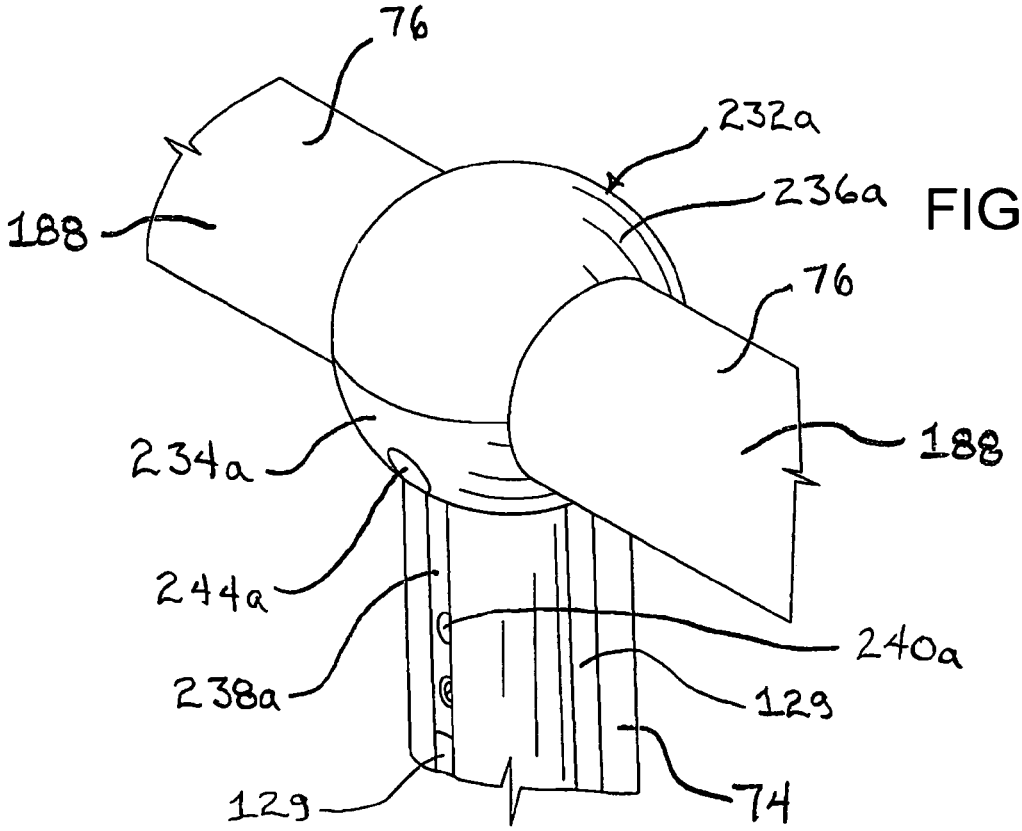
FIG. 39 is a perspective view of another assembled ball cap member.

Referring now to FIGS. 37-40, various cap members or ball cap members 232 are illustrated that may be used to cover or enclose the joined post members 74 and upper rail members 76. FIG. 39 illustrates a linear cap member 232*a* installed to a post member 74 and receiving or covering the ends of two separate upper rail members 76. Linear cap member 232*a* includes a lower cap section 234*a* and an upper cap section 236*a*. Lower cap section 234*a* is shown in an exploded relation to post member 74 in FIG. 37 and discloses the inclusion of two legs 238*a* that may be inserted into two of the slotted cavities 129 of post member 74. Legs 238*a* include holes 240*a* for receiving set screws or pins in the aforementioned manner to secure the lower cap section 234*a* to the post member 74. Lower cap section 234*a* also includes two leg holes 242*a* through which, for example, T-member 204 of extension 196, arms 220 of extension 210, or a leg 226 of extension 224 may be passed for installation into a slotted cavity 129 not occupied by a leg 238*a* of lower cap section 234*a*. Lower cap section 234*a* also includes holes 244*a* for receiving internally threaded posts (not shown) on upper cap section 236*a*, with the holes 244*a* of lower cap section 236*a* also enabling insertion of fasteners into the threaded posts.

Figure 40:
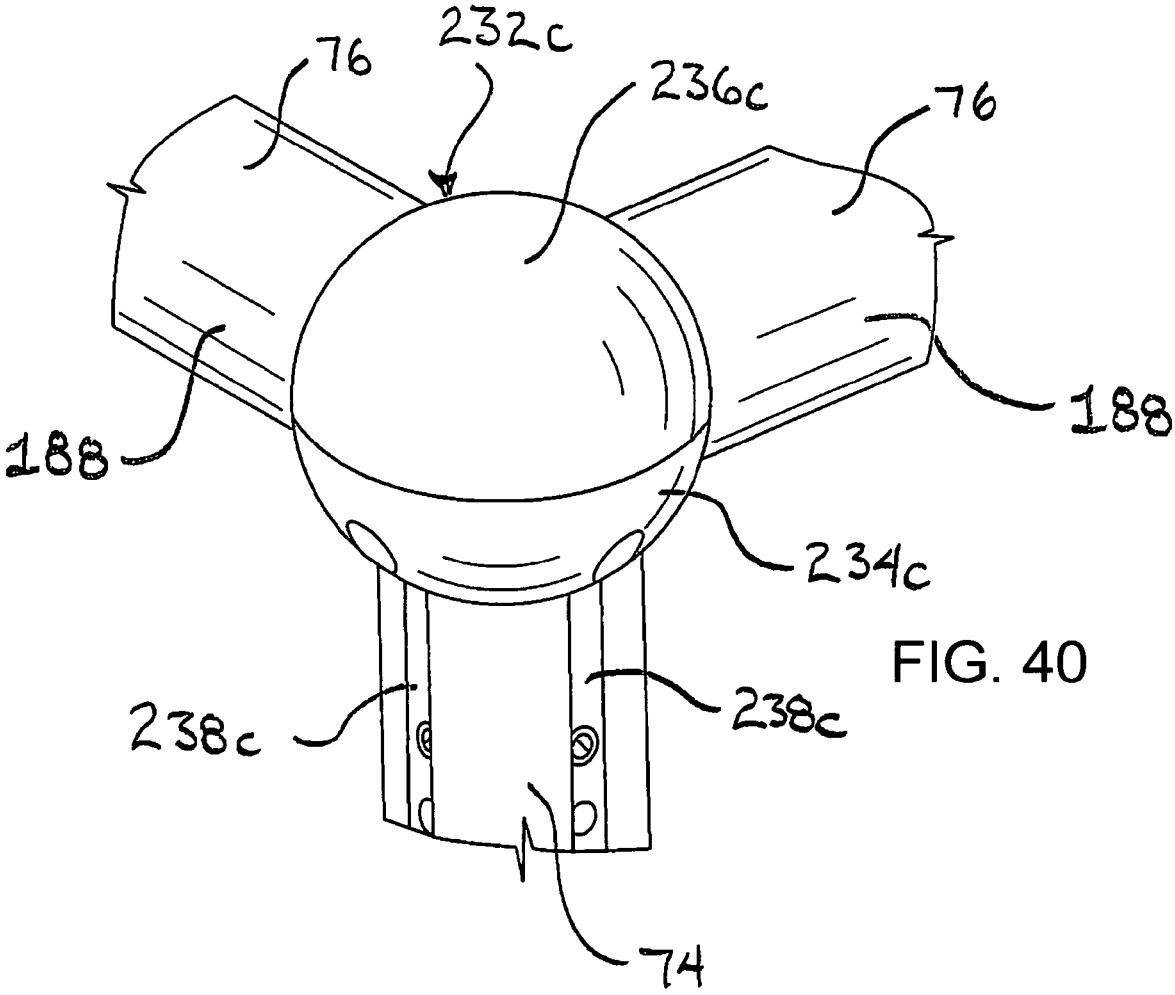
FIG. 40 is a perspective view of yet another assembled ball cap member.

The cap members 232*b*, 232*c* of FIGS. 38 and 40 are of generally similar construction to cap member 232*a* and include a lower cap section 234*b*, 234*c* with legs 238*b*, 238*c* for insertion into slotted cavities 129 of a post member 74 and an upper cap section 236*b*, 236*c* that is mountable to the lower cap section 234*b*, 234*c*. Cap member 232*b* of FIG. 38, however, is adapted to only receive a single upper rail 76. Cap member 232*b* may be used, for example, at the opening 82 of wheelchair ramp 60 adjacent the entrance/exit of a building or house or the like. Cap member 232*c* of FIG. 40 is adapted to receive two upper rails 76 that are assembled at a right angle and may be used, for example as shown in FIG. 1, at the intersections of step section 62*b* and a straight ramp section 62*c* with platform section 62*e*.

Figure 41:
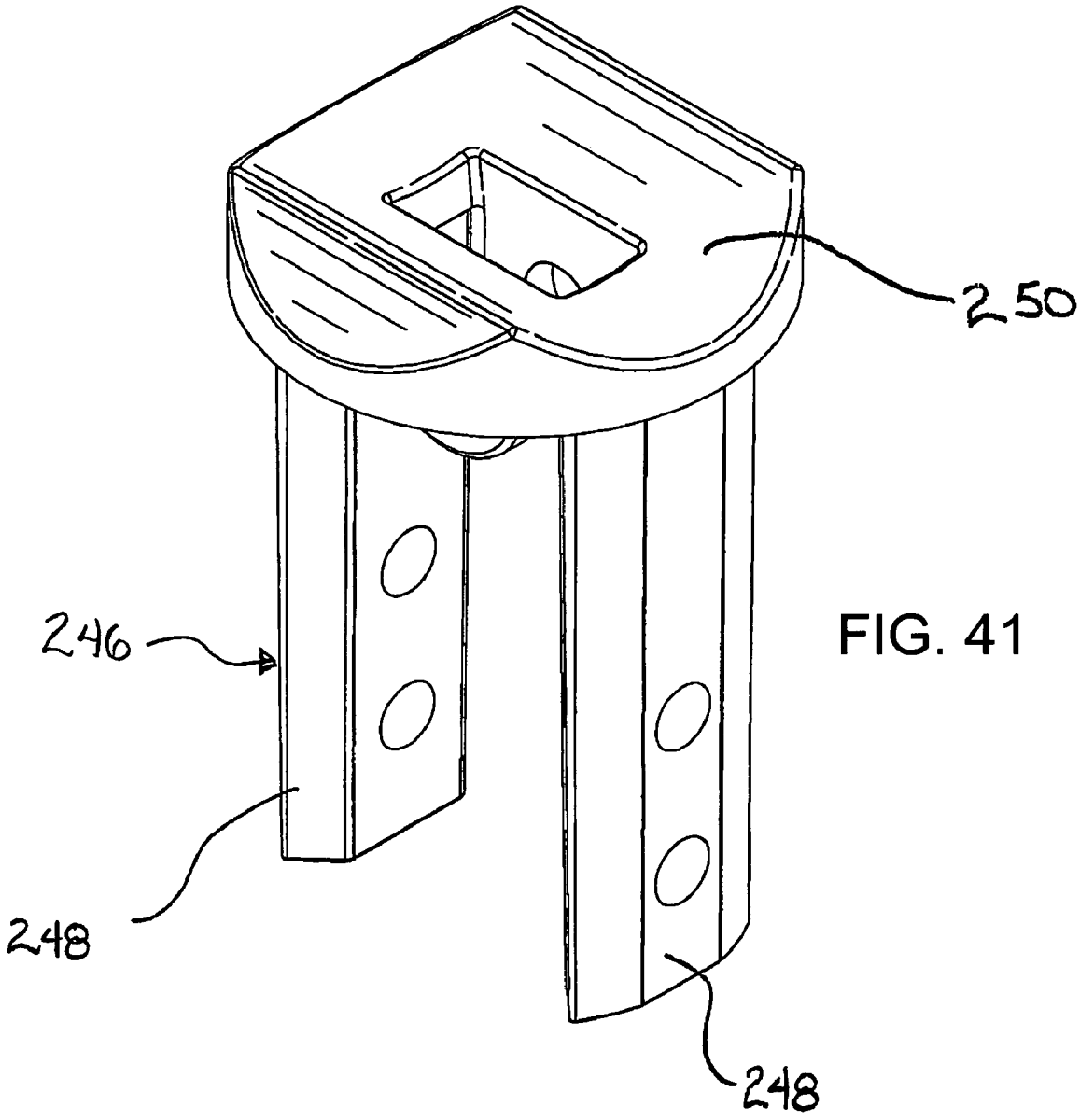
FIG. 41 is a perspective view of a support member for a vertical post member.
Figure 42:
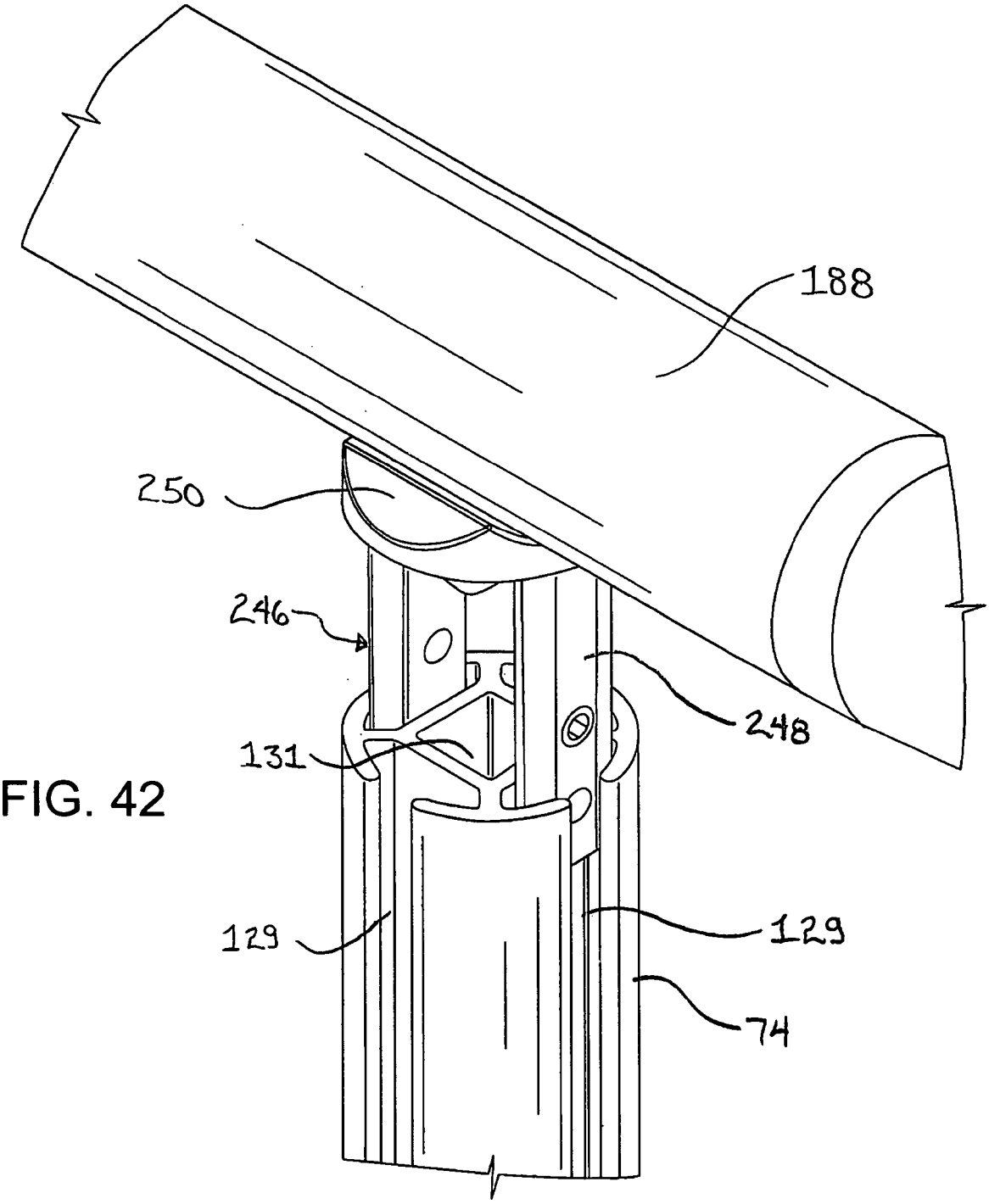
FIG. 42 is a partial perspective view of the insert member of FIG. 41 in exploded relation to a vertical post member and supporting a horizontal rail member.

Referring now to FIGS. 41 and 42, a support member 246 is illustrated having legs 248 of similar construction to legs 238*a* of lower cap section 234*a* described above, with legs 248 being shown in an exploded relation to a post member 74 in FIG. 42. Support member 246 includes a concave cap portion 250 for supporting a rod 188 and may be used, for example, at the entry/exit locations onto wheelchair ramp 60 at step section 62*b* and support surface section 62*a*, as shown in FIG. 1.

Railing assemblies 72*a*, 72*b* may also incorporate curved upper and lower rail members 252, 254, as shown in FIGS. 1 and 3. It should be appreciated that curved upper and lower rail members 252, 254 are of generally similar construction to upper and lower rail members 76, 78 discussed above, but are curved instead of being substantially straight. For example, curved upper and lower rail members 252, 254 may be formed from upper and lower rail members 76, 78 that are bent to a predetermined radius.

Figure 43:
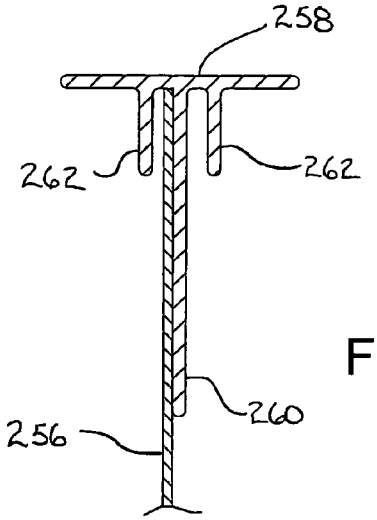
FIG. 43 is a cross-sectional view of a portion of a flexible wall member shown in mounted relation to a frame member taken along the line C-C of FIG. 44.
Figure 44:
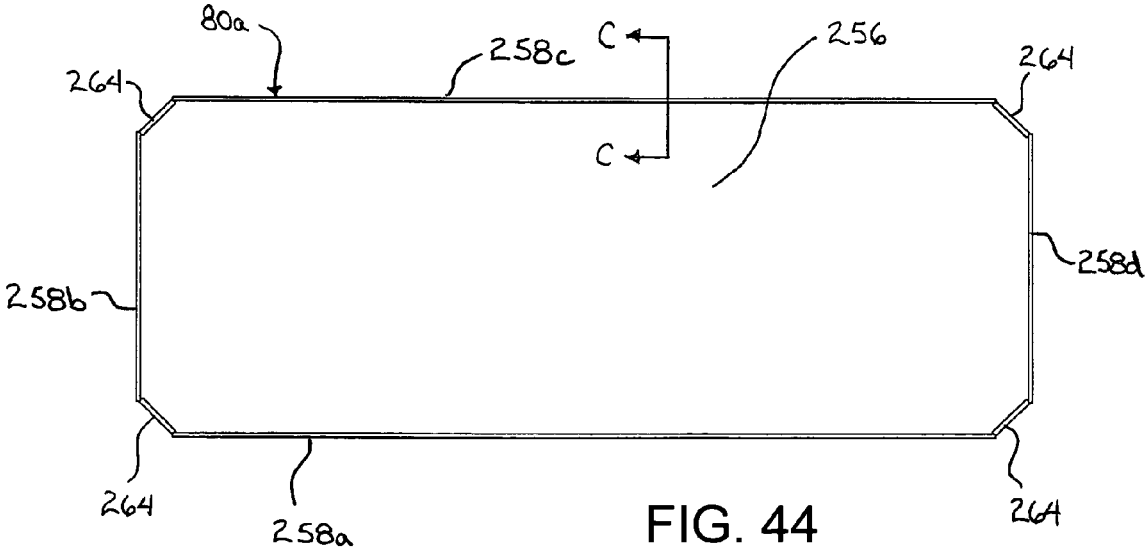
FIG. 44 is a side elevation view of a flexible wall assembly.
Figure 45:
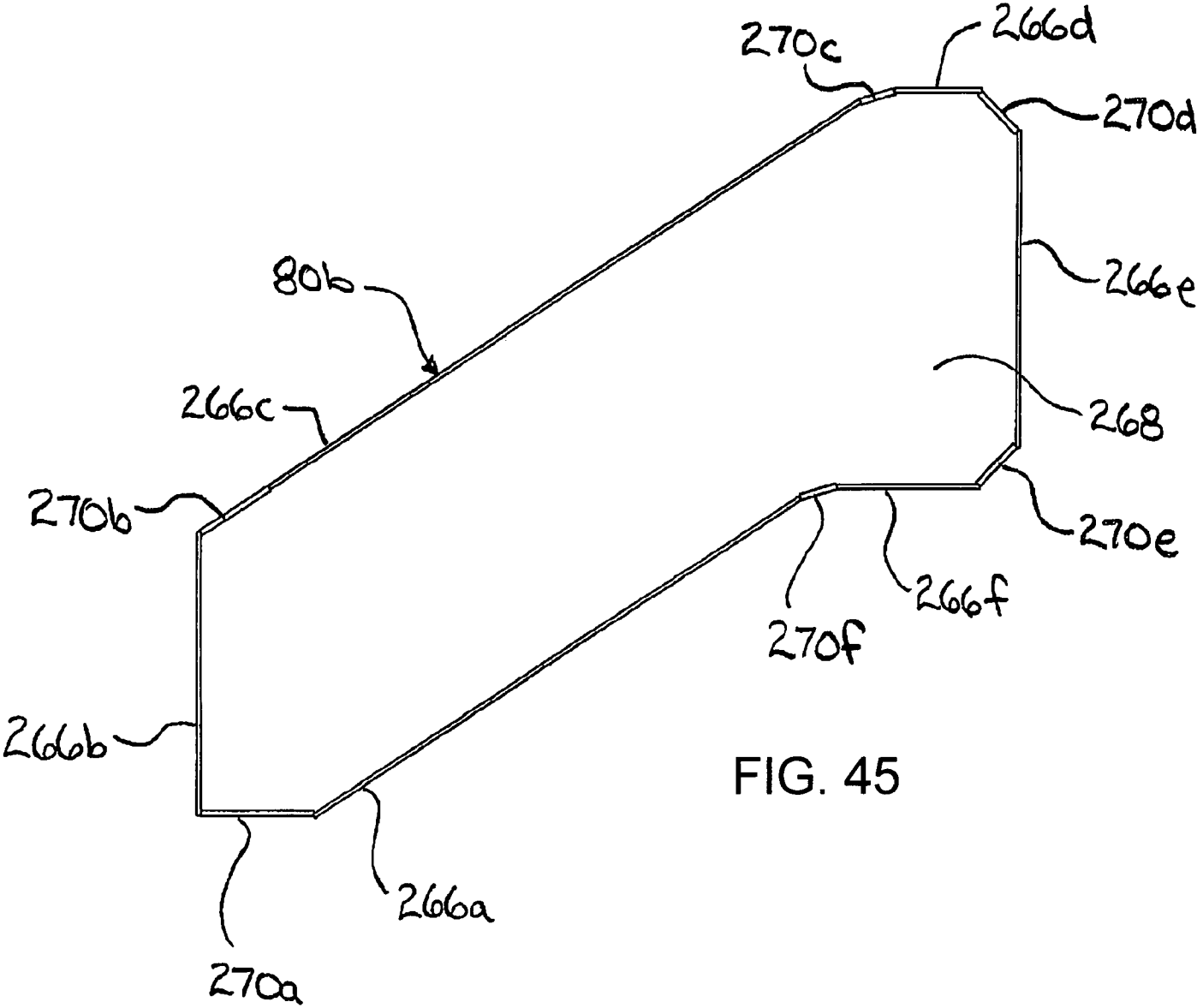
FIG. 45 is a side perspective view of an alternative flexible wall assembly.

Referring now to FIGS. 43-45 and as previously noted, railing assemblies 72*a*, 72*b* may also include additional railing components, such as components formed as flexible wall assemblies, such as flexible wall assembly 80*a* shown in FIG. 44 and flexible wall assembly 80*b* shown in FIG. 45. Flexible wall assemblies 80 are adapted to be installed to and between adjacent post members 74 and to and between the upper and lower rail members 76, 78, 252, 254 extending between the adjacent post members 74.

FIG. 44 illustrates a flexible wall assembly 80*a* that may be installed to wheelchair ramp proximate a straight ramp section 62*c*. Flexible wall assembly 80*a* includes a flexible material or wall 256, such as a fabric or cloth material that may be formed of a polymeric material or cotton or the like and which may be constructed as a mesh material. Flexible wall assembly 80*a* also includes four frame members 258*a*-258*d* disposed about the periphery of flexible material, the frame members 258*a*-258*d* being substantially similar, but of differing length. FIG. 43 illustrates that frame members 258, which may be constructed as an aluminum extrusion, include a central leg 260 to which flexible wall 256 may be attached, such as by being sewn or adhered thereto by an adhesive. Frame members 258 also include outer legs 262 that are formed to fit within the slotted cavity 129, 194 openings of post members 74 and upper and lower rails 76, 78. Flexible wall assembly 80*a* includes four angled corners at which flexible material is doubled over and sewn or adhered against itself to form a hemmed edge 264.

FIG. 45 illustrates a flexible wall assembly 80*b* that is of generally similar construction to flexible wall assembly 80*a* above, but which may be installed to wheelchair ramp 60 proximate a step section 62*b*. As shown, flexible wall assembly 80*b* includes six frame members 266*a*-266*f* disposed about the periphery of a flexible material 268, and six hemmed edges 270*a*-270*f*.

Figure 46:
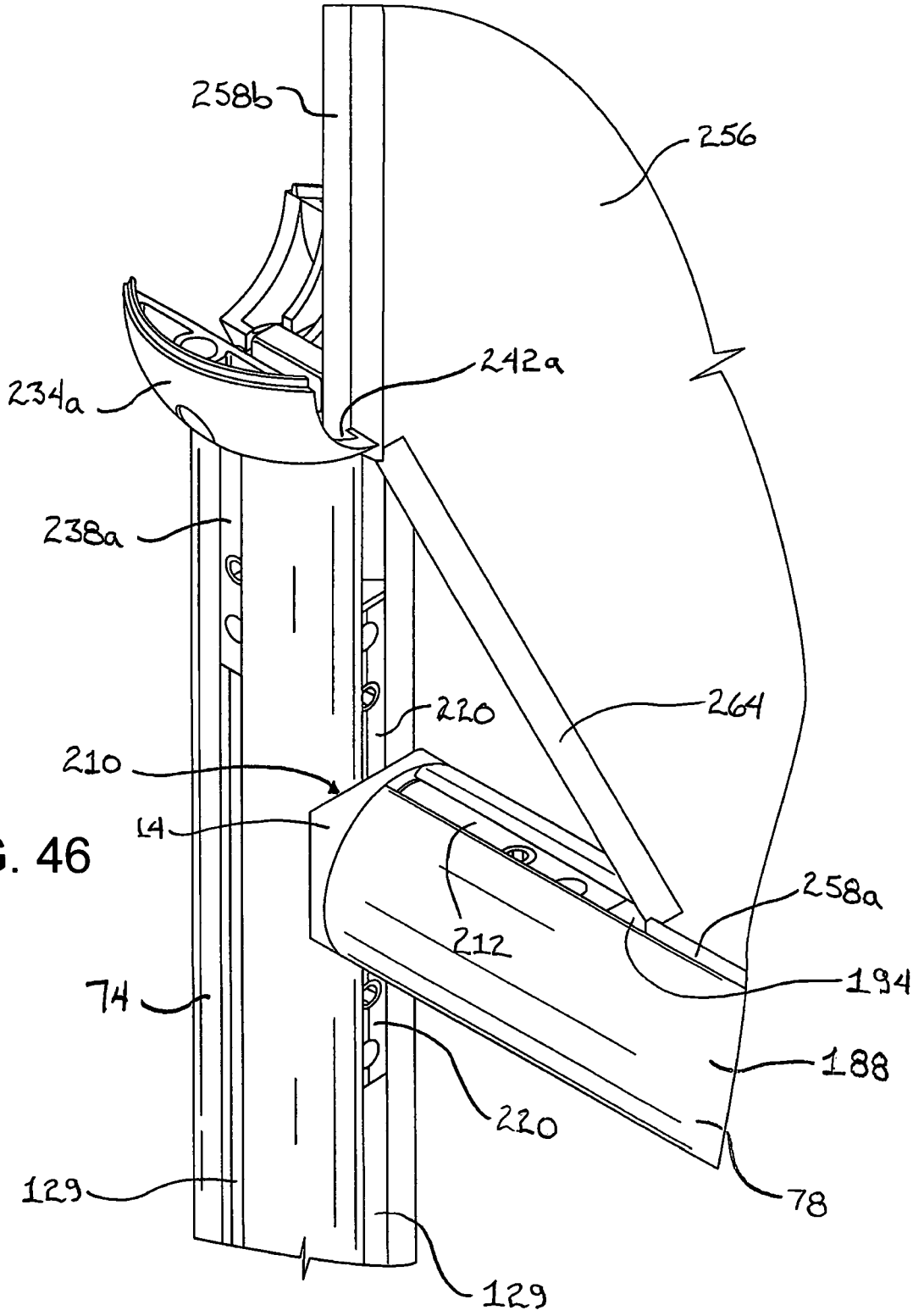
FIG. 46 is a partial perspective view of a flexible wall assembly being installed to a horizontal rail member and vertical post member.

Referring now to FIG. 46, the assembly of flexible wall assembly 80*a* to post member 74 and lower rail member 78 is illustrated. Initially, frame member 258*a* to which flexible material 256 is sewn is inserted into slotted cavity 194 of lower rail member 78 prior to installation of extension 210. Next, extension 210 is lowered into slotted cavity 129 of post member 74, as illustrated, such that frame member 258*b* may be inserted through leg hole 242*a* and into the slotted cavity 129 of post member 74. It should be understood that although not shown in FIG. 46, the extension 210 on the opposite end of lower rail member 78 is similarly inserted along with frame member 258*d* into the adjacent post member 74. Although not shown, the upper frame 258*c* is inserted into the downwardly directed slotted cavity 194 of an upper rail member 76 in similar manner to lower rail member 78.

It should be appreciated that flexible wall assemblies 80*a*, 80*b* may thus provide a barrier to inhibit individuals or objects from falling off of wheelchair ramp 60. However, as shown in FIGS. 1 and 2, wheelchair ramp 60 may also include multiple vertical posts 272 installed between upper and lower rail members 76, 78 in place of flexible wall assemblies 80*a*, 80*b*. Such vertical posts 272, for example, may include extensions 196 or 210 at either end of the vertical posts 272 for insertion into the slotted cavity 194 of the upper and lower rail members 76, 78. A wheelchair ramp may also be constructed without a flexible wall assembly or even without a rail assembly and still function as intended within the scope of the present invention.

Figure 47:
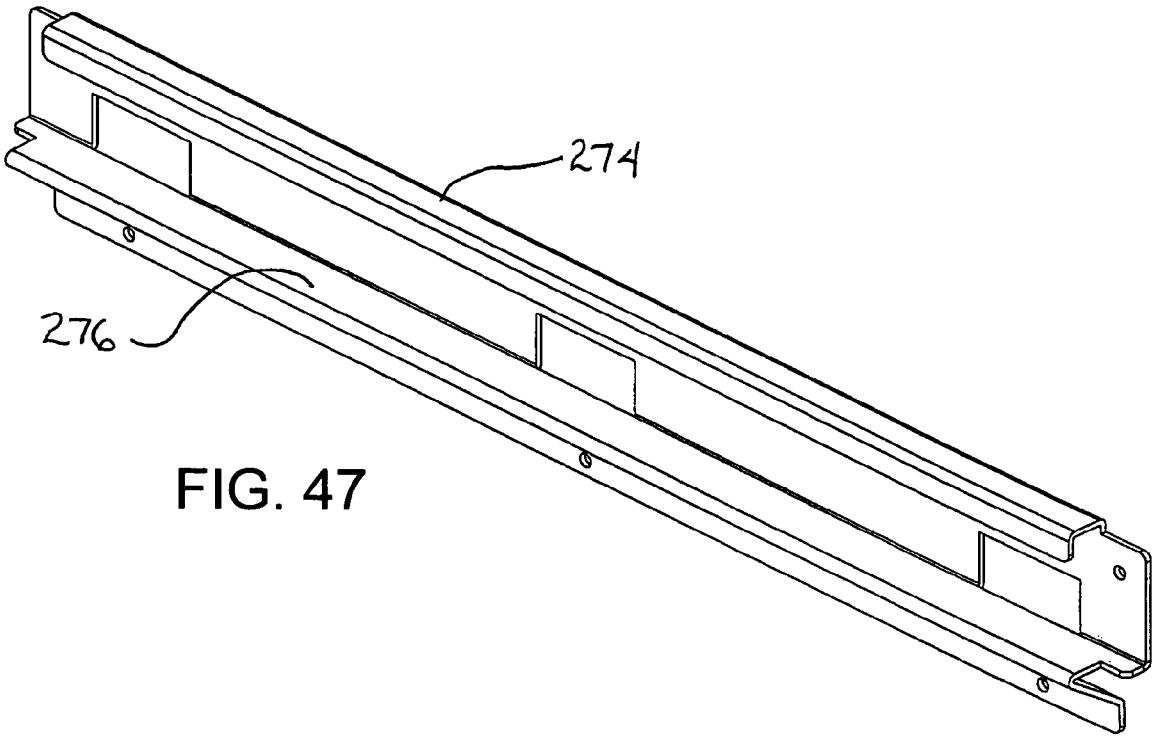
FIG. 47 is a perspective view of a structure mounting bracket.
Figure 48:
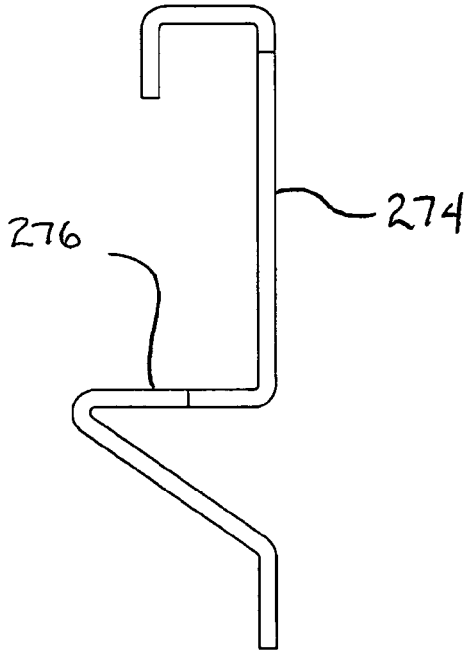
FIG. 48 is a side elevation view of the bracket of FIG. 47.
Figure 49:
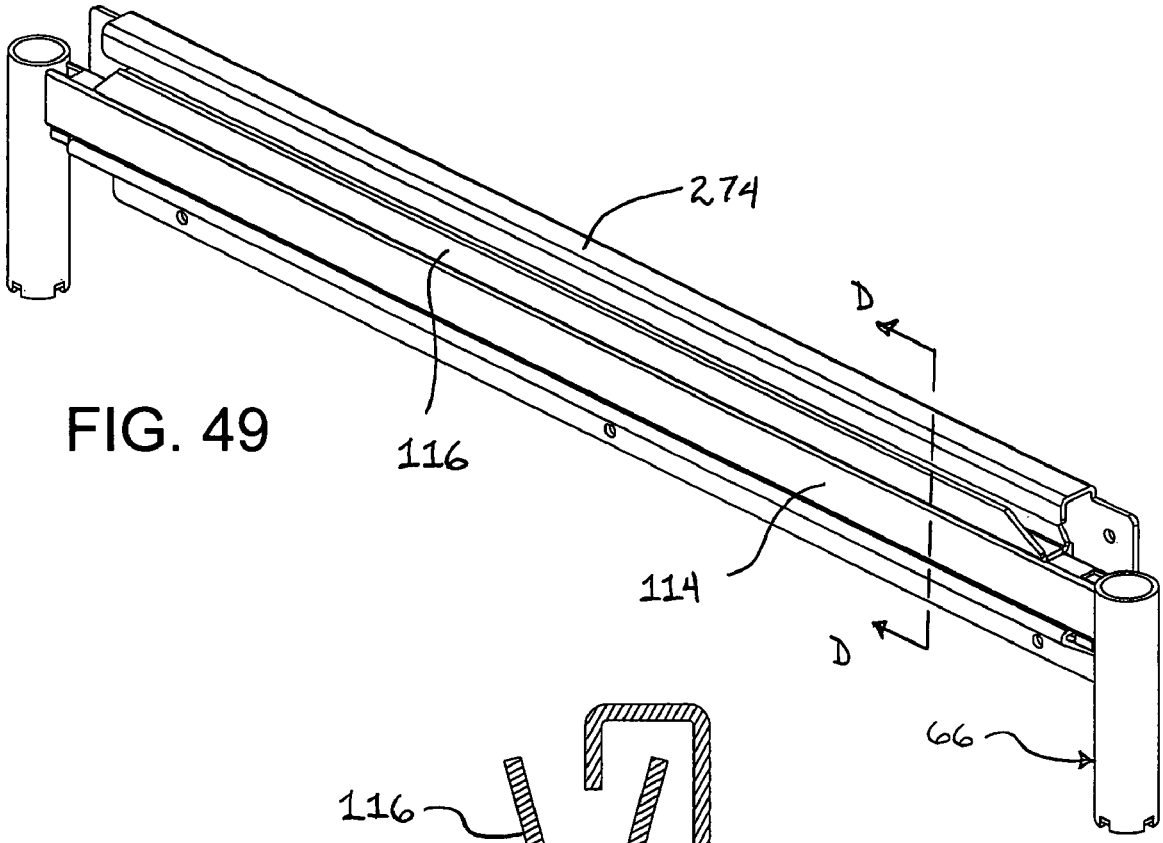
FIG. 49 is a perspective view of the structure mounting bracket of FIG. 47 shown in relation to a partially shown support structure.
Figure 50:
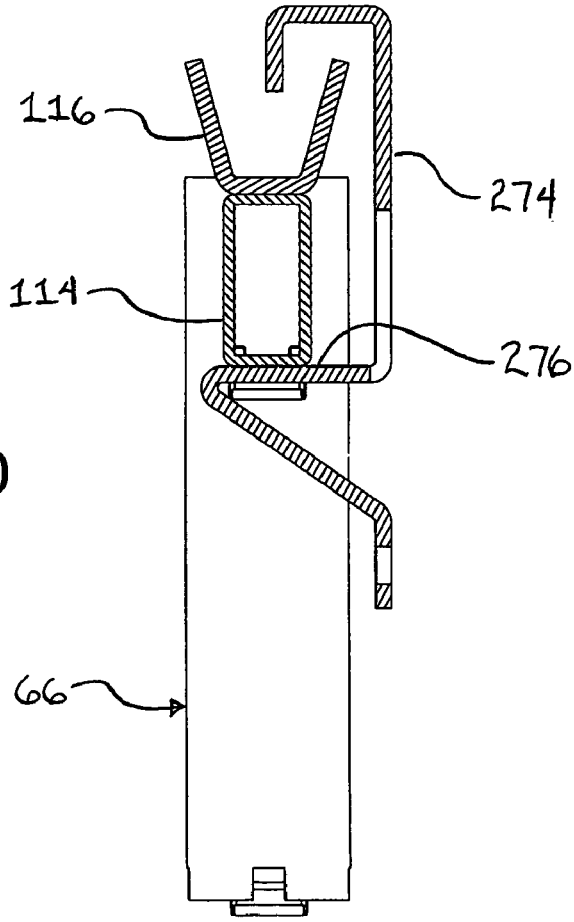
FIG. 50 is a side cross-sectional view of FIG. 49 taken along the line D-D.

FIGS. 47 and 48 illustrate a structure bracket 274 that may be affixed to a building or structure or the like adjacent the entrance/exit of the building to enable wheelchair ramp 60 to be secured thereto. For example, the structure bracket 274 may be secured to a structure and the structure mounting edge 96 of platform section 62*e* may be positioned onto ledge 276 of structure bracket 274. Alternatively, as illustrated in FIGS. 49 and 50, structure bracket 274 may be used in connection with a support structure 66 (partially shown in FIGS. 49 and 50) such that a mounting edge 68*e* of a platform section 62*e*, for example, may be placed within receptacle member 116.

Figure 51:
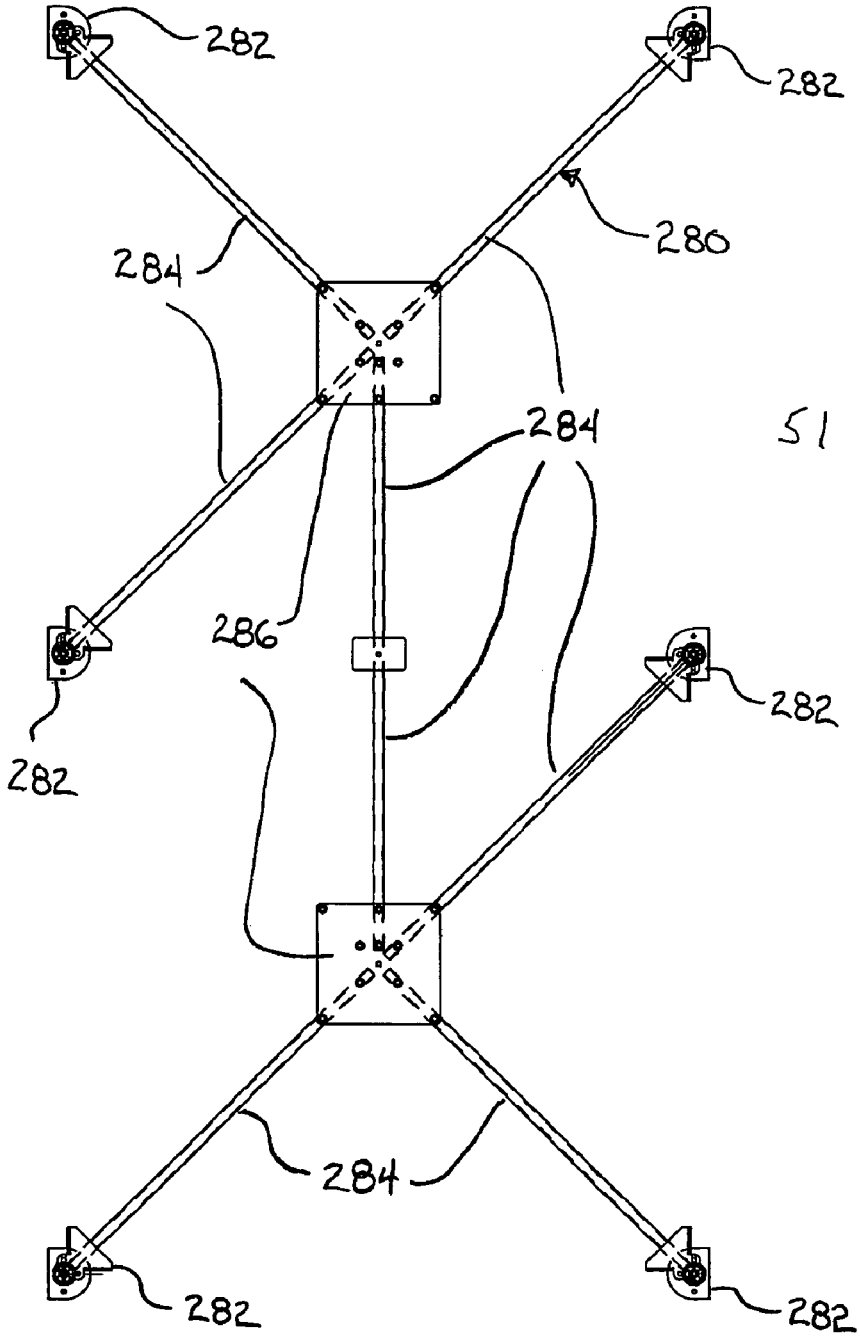
FIG. 51 is a top plan view of a platform support assembly.
Figure 52:
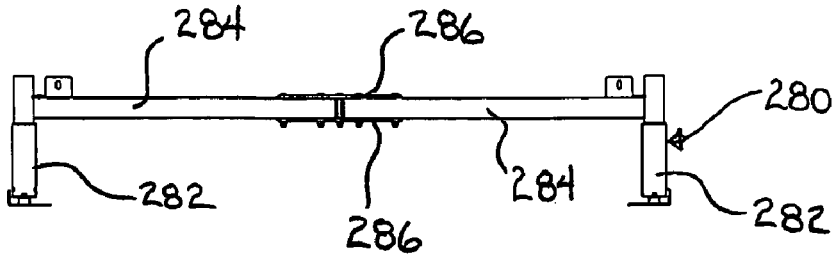
FIG. 52 is a side elevation view of the platform support assembly of FIG. 51.
Figure 53:
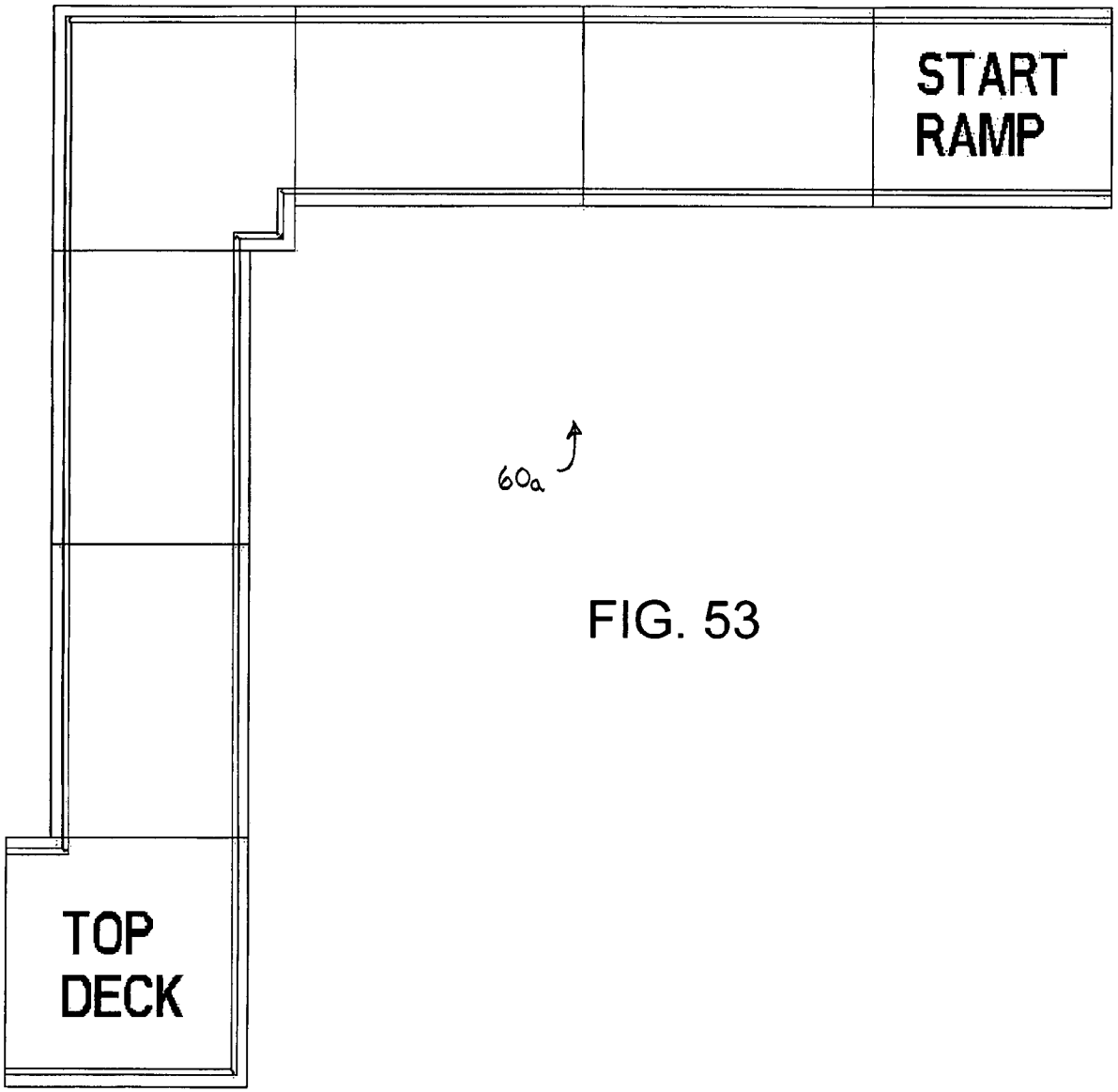
FIG. 53 is a top plan view of an alternatively configured wheelchair ramp in accordance with the present invention.
Figure 54:
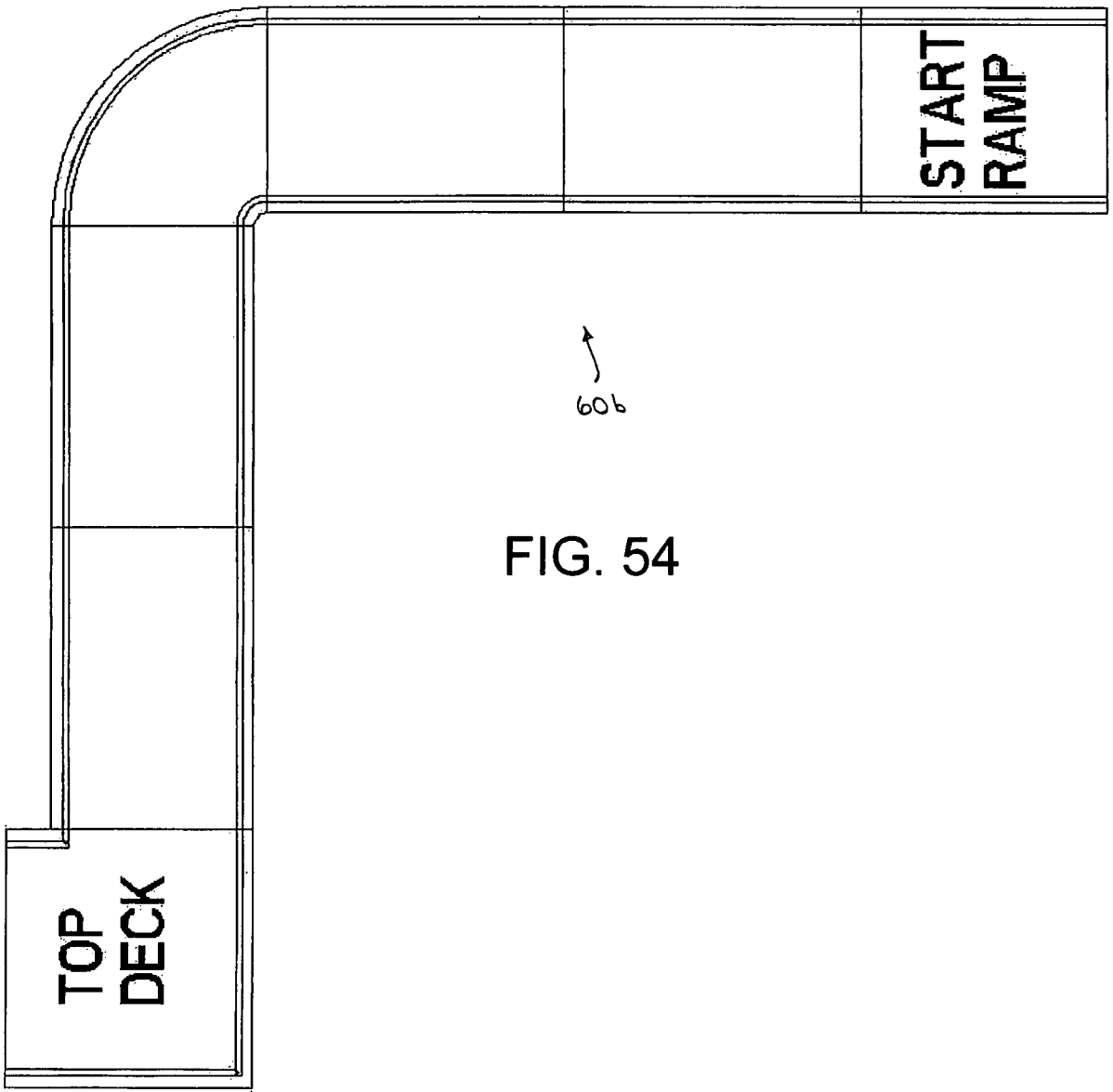
FIG. 54 is a top plan view of an alternatively configured wheelchair ramp in accordance with the present invention.
Figure 55:
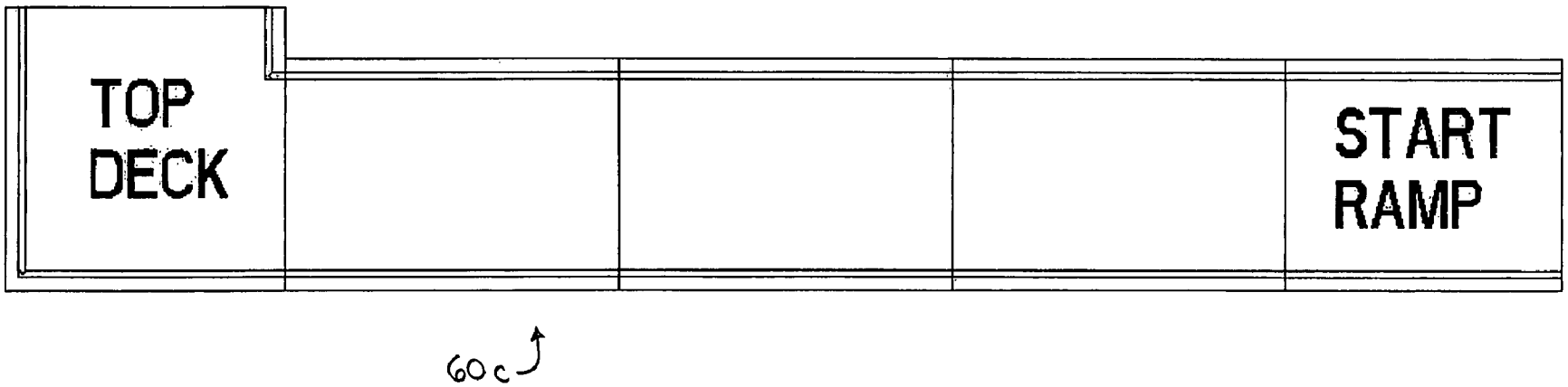
FIG. 55 is a top plan view of an alternatively configured wheelchair ramp in accordance with the present invention.
Figure 56:
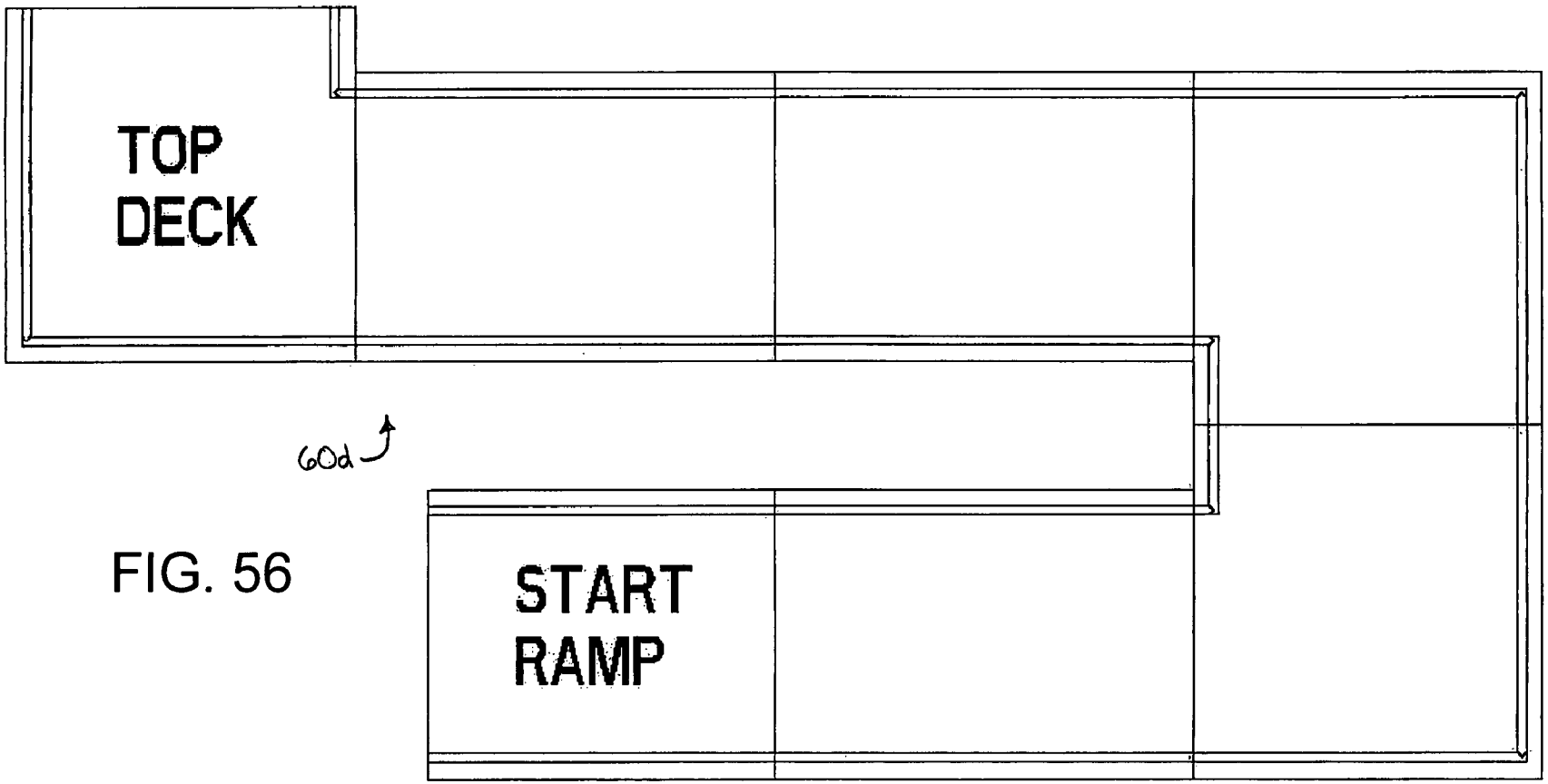
FIG. 56 is a top plan view of an alternatively configured wheelchair ramp in accordance with the present invention.
Figure 57:
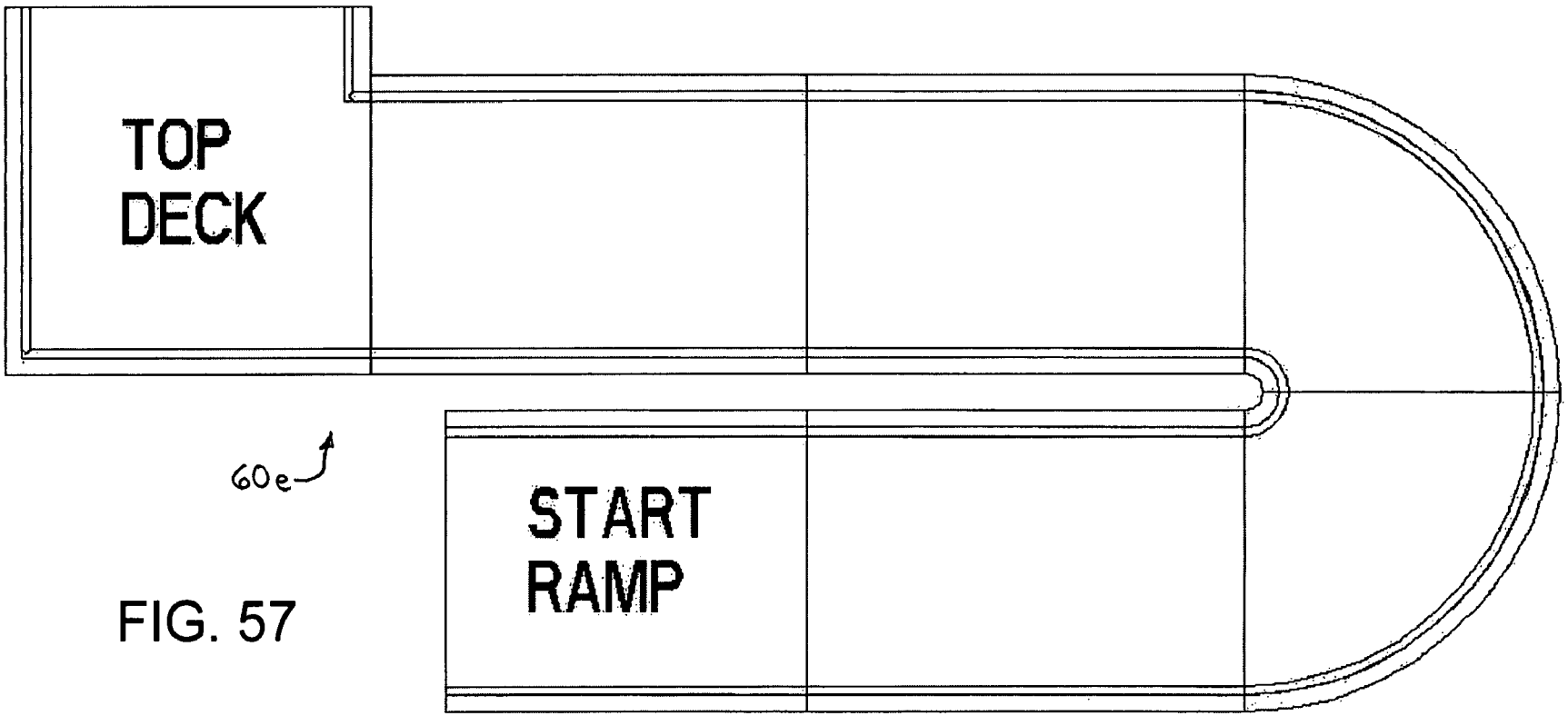
FIG. 57 is a top plan view of an alternatively configured wheelchair ramp in accordance with the present invention.

FIGS. 51 and 52 illustrate a support assembly 280 that may be used with, for example, one or more platform sections. Support assembly 280 includes multiple telescoping pedestal members 282 and horizontal members 284 joined by brace plates 286.

It should be appreciated that numerous alternative overall configurations/shapes for wheelchair ramps relative to wheelchair ramp of FIGS. 1-3 may be formed using the components of the present invention. For example, FIGS. 53-57 illustrate exemplary alternative wheelchair ramps 60*a*-60*e* that may be formed using the above described ramp sections 62, support structures 62, clamp members 70, and rail assemblies 72.

Further, it should also be appreciated that the various components and configurations of the wheelchair ramp of the present invention may be alternatively configured and still function as intended within the scope of the present invention. For example, support structures may be configured to support ramp sections along the side edges of the ramp sections extending along the path of travel on the wheelchair ramp. In addition, the above described post members and upper and lower rail members may alternatively not be formed as extrusions and/or may not include slotted cavities and/or slots. For example, the various post members and rail members may be formed as solid or hollow tubes that include holes and/or studs, or the like, for assembly. In addition, a single clamp member may be used to simultaneously secure ramp sections to support structures, or clamp members may be used to secure a single ramp section, as opposed to simultaneously securing two ramp sections. Still further, alternative clamp members may be used that are not affixed to post members and/or do not have or have alternative clamp faces.

The modular wheelchair ramp of the present invention is adapted to be readily assembled in numerous configurations. The wheelchair ramp is constructed of multiple, variously configurable ramp sections that are adapted to be assembled together to form or define a ramp surface upon which a wheelchair may traverse. The ramp sections may be constructed of a molded plastic or polymeric material and may be held in an elevated orientation by support structures that may simultaneously receive mounting edges of adjacent ramp sections. Clamp members may then be used to securely clamp the adjacent ramp sections to the support structures. The wheelchair ramp may also be provided with adjustably formed railing assemblies that may include flexible wall assemblies installed to the railing assemblies. The variously configurable railing assemblies, ramp sections, support structures, and clamp members thus enable wheelchair ramps to be readily assembled in numerous layouts or configurations.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A wheelchair ramp, comprising:

a plurality of ramp sections, said ramp sections being adapted for assembly to define a ramp surface upon which a wheelchair may traverse;

a plurality of support structures; and a plurality of clamp members;

said support structures being adapted to support said ramp sections in an elevated orientation with said clamp members adapted to clamp said ramp sections to said support structures, wherein said ramp sections include a plurality of side edges extending on opposing sides of the ramp surface and elevated above the ramp surface said ramp sections further include a mounting edge, disposed on opposing ends of said ramp sections, said mounting edges extend downwardly from the ramp surface and extends substantially the entire distance between said side edges, and wherein said support structures include a generally horizontal member, said horizontal members being adapted to receive at least one mounting edge of adjacent ramp sections, said horizontal members include an upwardly facing u-shaped receptacle spanning substantially across the entirety of said horizontal members, said receptacle being adapted to receive said receptacle being adapted to receive said two mounting edges of adjacent ramp sections, to, in turn, support each one of said at least one mounting edges along the entire length thereof.

2. The wheelchair ramp of claim 1 wherein said clamp members being adapted to clamp said at least one mounting edges of adjacent said ramp sections in adjoining relationship, wherein each said at least one mounting edge includes at least one clamp socket defining a recess with said at least one clamp socket being located distally along the length of said mounting edge, and wherein said at least one clamp sockets of adjacent said ramp sections are adapted to align when said at least one mounting edges are in adjoining relationship, and wherein said recesses of aligned said at least one clamp sockets of adjacent said ramp sections are simultaneously engaged by a single said clamp member.

3. The wheelchair ramp of claim 2, wherein said at least one clamp socket on each said at least one mounting edge comprises two clamp sockets on each said at least one mounting edge, said clamp sockets being generally distally located from each other on said at least one mounting edge, and wherein said clamp sockets of adjoining said at least one mounting edges are adapted to align when said ramp sections are clamped in adjoining relationship.

4. The wheelchair ramp of claim 2, wherein said plurality of ramp sections includes a first and last ramp section and a plurality of central ramp sections, and wherein said central ramp sections each include two mounting edges, said mounting edges of said central ramp sections being adapted to engage said mounting edges of adjacent said central ramp sections.

5. The wheelchair ramp of claim 2, wherein said ramp sections comprise at least one selected from the group consisting of a step section, a curved section, and a generally horizontal platform section.

6. The wheelchair ramp of claim 1, wherein said clamp members are adapted to be mounted to said support structures.

7. The wheelchair ramp of claim 6, wherein said support structures include two vertical members with said horizontal member extending between said vertical members, and wherein said support structures are adapted to be positioned such that said horizontal members are oriented generally perpendicularly to the direction of travel on said wheelchair ramp.

8. The wheelchair ramp of claim 6, wherein one said clamp members is adapted to be affixed to each said vertical member of said support structures.

9. The wheelchair ramp of claim 1, wherein said support structures including at least one generally vertical member extending above said ramp surface, said at least one generally vertical member including at least one elongated vertical slot extending substantially the entire length above said ramp surface;

and a plurality of railing components, said railing components having first and second rail ends with first and second insert members at said first and second rail ends;

said clamp members adapted to clamp said ramp sections to said support structures, and at least one said railing component extending between said at least one vertical members of adjacent said support structures with said first insert member being slidably inserted into said at least one slot of one said vertical member and said second insert member being slidably inserted into said at least one slot of the adjacent said vertical member.

10. The wheelchair ramp of claim 9, wherein said railing components are at least one of a lower rail member and an upper rail member, said first and second insert members of said lower and upper rail members being inserted into said slots of adjacent said vertical members such that said rail members are disposed between adjacent said vertical members.

11. The wheelchair ramp of claim 9, wherein said first and second insert members are at least one of generally T-shaped and generally L-shaped.

12. The wheelchair ramp of claim 11, wherein said first and second insert members are pivotally affixed to said railing component.

13. The wheelchair ramp of claim 9, wherein said support structures include two generally vertical members and a generally horizontal member extending between said vertical members, said horizontal members being adapted to support said ramp sections with the direction of travel on said wheelchair ramp extending between the associated said vertical members.

* * * * *